US009741510B2

(12) United States Patent
Suzuki et al.

(10) Patent No.: US 9,741,510 B2
(45) Date of Patent: Aug. 22, 2017

(54) SWITCH DEVICE

(71) Applicants: Takashi Suzuki, Aichi (JP); Takashi Nose, Aichi (JP); Yoshinobu Sasatani, Aichi (JP)

(72) Inventors: Takashi Suzuki, Aichi (JP); Takashi Nose, Aichi (JP); Yoshinobu Sasatani, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 0 days.

(21) Appl. No.: 15/164,524

(22) Filed: May 25, 2016

(65) Prior Publication Data

US 2016/0351361 A1 Dec. 1, 2016

(30) Foreign Application Priority Data

May 25, 2015 (JP) ..... 2015-105135

(51) Int. Cl.

| | |
|---|---|
| ***H01H 3/20*** | (2006.01) |
| ***H01H 15/10*** | (2006.01) |
| ***H01H 15/04*** | (2006.01) |
| ***H01H 19/635*** | (2006.01) |
| ***H01H 23/16*** | (2006.01) |

(52) U.S. Cl.

CPC ..... *H01H 15/10* (2013.01); *H01H 15/04* (2013.01); *H01H 19/635* (2013.01); *H01H 23/168* (2013.01); *H01H 2300/01* (2013.01)

(58) Field of Classification Search

CPC ..... H01H 13/12; H01H 23/00; H01H 23/003; H01H 9/02; H01H 2085/208; H01H 1/5822; H01H 3/00; H01H 3/02; B60R 16/005; B60R 21/09

USPC ..... 200/245, 329, 332, 532, 535

See application file for complete search history.

(56) References Cited

U.S. PATENT DOCUMENTS 5,065,276 A * 11/1991 Chou ..... H01H 15/005 200/16 D
5,647,478 A * 7/1997 Hirai ..... H01H 23/02 200/292

(Continued)

FOREIGN PATENT DOCUMENTS

| | | | |
|---|---|---|---|
| JP | S55-136132 | U | 9/1980 |
| JP | H09-245565 | A | 9/1997 |
| JP | 2014-034787 | A | 2/2014 |

*Primary Examiner* — Vanessa Girardi

(74) *Attorney, Agent, or Firm* — Osha Liang LLP

(57) ABSTRACT

A switch device includes a substrate including stationary contacts arranged side by side, a contact including linear parts having elasticity and movable contacts, a housing holding a base of the contact and including beams having elasticity each of which is disposed above the corresponding one of the linear parts, and a slider disposed above the housing. A first pressing part is formed on a lower face of each of the beams, and a pressed part is formed on an upper face thereof. Second pressing parts are formed on the slider. When the slider moves in the front-back direction in conjunction with the operation of an operation knob, the second pressing parts press the pressed parts to bend the beams downward, the first pressing parts press the linear parts to bend the linear parts downward, and the movable contacts come into contact with the stationary contacts.

10 Claims, 17 Drawing Sheets

(56) References Cited

U.S. PATENT DOCUMENTS

| | | | | |
|---|---|---|---|---|
| 6,097,105 | A * | 8/2000 | Oikawa | H01H 23/003 200/5 R |
| 6,657,316 | B1 * | 12/2003 | Smith | B60J 7/0573 307/10.1 |
| 6,884,954 | B2 * | 4/2005 | Onodera | H01H 19/635 200/339 |
| 7,507,919 | B2 * | 3/2009 | Sugahara | H01H 25/06 200/6 A |
| 7,851,714 | B2 * | 12/2010 | Kakuno | H01H 23/003 200/16 A |

* cited by examiner

A-A cross section (neutral, opening operation)

A'-A' cross section (neutral, opening operation)

B-B cross section (neutral, opening operation)

D-D cross section (neutral, opening operation)

D-D cross section (opening operation)
Fig. 12B(b')
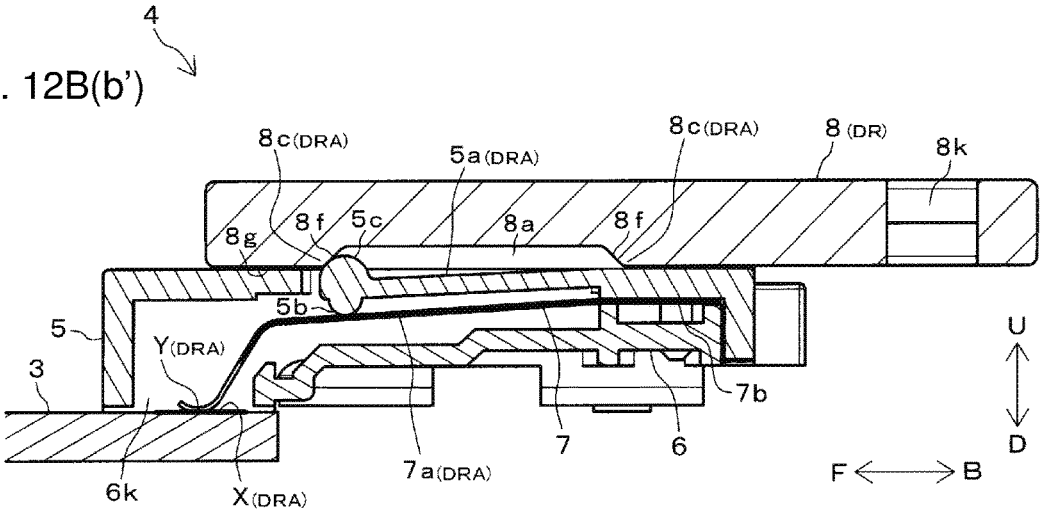
Fig. 12B(c)
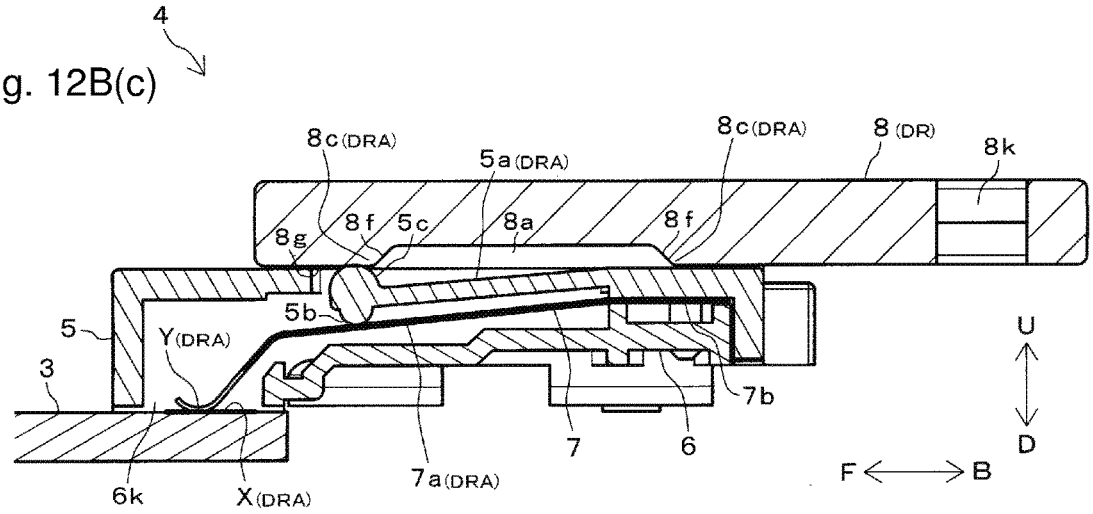

A-A cross section (closing operation)

A'-A' cross section (closing operation)

C-C cross section (neutral, closing operation)

D-D cross section (closing operation)

Fig. 16(d')

SWITCH DEVICE

CROSS-REFERENCE TO RELATED APPLICATION

This application is based on Japanese Patent Application No. 2015-105135 filed with the Japan Patent Office on May 25, 2015, the entire contents of which are incorporated herein by reference.

FIELD

The disclosure relates to the structure of a switch device in which a movable contact moves on a stationary contact to switch a contact/separate state between the movable contact and the stationary contact.

BACKGROUND

For example, JP 55-136132 Y and JP 9-245565 A disclose switch devices in which a movable contact moves in response to the operation of an operation knob to switch a contact/separate state between the movable contact and a stationary contact.

In the switch device of JP 55-136132 Y, a plurality of stationary contacts are disposed on the upper face of a substrate, and a slider is mounted on the substrate. The slider includes a plurality of contact pieces having elasticity. A movable contact is formed on the tip of each of the contact pieces so as to be in contact with the upper face of the substrate. An operation knob which can be operated to swing is disposed directly above the slider. A projection projecting downward is formed on the operation knob. The lower end of the projection is engaged with the upper part of the slider. When the operation knob is operated to swing, the projection turns, and the slider moves in the front-back direction. Accordingly, the contact piece slides on the substrate, and the movable contacts come into contact with or away from the stationary contacts.

In the switch device of JP 9-245565 A, a plurality of stationary contacts are arranged side by side in the front-back and right-left directions on the upper face of an insulator. The stationary contacts have different lengths in the front-back direction. Each of the stationary contacts is connected to the substrate through a terminal. A contact holder is mounted on the insulator. Movable contacts are disposed on the contact holder so as to be in contact with the insulator. An operation knob which can be operated to swing is disposed at a position away from the insulator. A projection projecting downward is formed on the operation knob. The lower end of the projection is engaged with one end of an arm. The other end of the arm is fixed to the contact holder. When the operation knob is operated to swing, the projection turns, and the arm and the contact holder move in the front-back direction. Accordingly, the movable contacts slide on the insulator so as to come into contact with or away from the stationary contacts.

When a plurality of stationary contacts are disposed on the substrate in a dispersed manner in the front-back and right-left directions, the size of the substrate may be increased in a plane direction. In particular, when a plurality of operation knobs are provided, the number of stationary contacts also increases. Thus, the size of the substrate is further increased. Even when a plurality of stationary contacts are arranged directly under the corresponding operation knob, the size of the substrate is further increased. The increase in the size of the substrate hinders downsizing of the switch device.

SUMMARY

An object of the disclosure is to provide a switch device that enables downsizing of a substrate.

A switch device according to one or more embodiments of the disclosure includes a substrate including a plurality of stationary contacts arranged side by side in a first direction; a contact including a plurality of linear parts having elasticity and a plurality of movable contacts, each of the movable contacts formed on a lower face of the corresponding one of the linear parts; a housing configured to hold a base of the contact so that each of the stationary contacts faces the corresponding one of the movable contacts, the housing including a plurality of beams having elasticity, each of the beams disposed above the corresponding one of the linear parts; a slider disposed above the housing, the slider configured to move in a second direction perpendicular to the first direction and an up-down direction; a plurality of first pressing parts, each of the first pressing parts formed on a lower face of the corresponding one of the beams and configured to press the corresponding one of the linear parts downward; a plurality of pressed parts, each of the pressed parts formed on an upper face of the corresponding one of the beams; and a plurality of second pressing parts formed on the slider, each of the second pressing parts configured to press the corresponding one of the pressed parts. When the slider moves in the second direction, the second pressing parts press the pressed parts to bend the beams downward, the first pressing parts press the linear parts to bend the linear parts downward, and the movable contacts come into contact with the stationary contacts.

According to the above, the plurality of stationary contacts are arranged side by side in the first direction on the substrate, and the housing holds the contact so that each of the stationary contacts faces the corresponding one of the movable contacts. That is, the stationary contacts are arranged side by side in the first direction in a collective manner and the movable contacts are arranged side by side in the side direction in a collective manner on the substrate. Thus, the substrate of the switch device can be downsized. Further, when the slider is moved in the second direction, the second pressing parts of the slider press the pressed parts of the housing to bend the beams of the housing downward. Accordingly, the first pressing parts of the housing press the linear parts of the contact to bend the linear parts downward, and each of the movable contacts comes into contact with the corresponding one of the stationary contacts. During the contact, each of the movable contacts slides against the corresponding one of the stationary contacts. Thus, the surfaces of both the movable contact and the stationary contact are cleaned, which enables the contact reliability between the movable contact and the stationary contact to be improved. Further, in a normal condition, the movable contact is separated from the substrate and the stationary contact. When the slider moves, the movable contact is brought into contact with the substrate and the stationary contact. This enables wear on each of the movable and stationary contacts and the substrate to be reduced.

In one or more embodiments of the disclosure, the above switch device may further include an operation knob configured to swing and a lever including an upper end coupled to the operation knob and a lower end coupled to the slider. The stationary contacts and the movable contacts may be disposed at positions that are off a position directly under the operation knob. The slider may be disposed in a manner to extend from the position directly under the operation knob to a position directly above the housing. When the operation knob is operated, the lever may turn to reciprocate the slider in the second direction.

In one or more embodiments of the disclosure, in the above switch device, a pressing length of pressing each of the pressed parts downward by the corresponding one of the second pressing parts may change according to a moving length of the slider in the second direction.

In one or more embodiments of the disclosure, in the above switch device, each of the pressed parts may include a projecting curved surface projecting toward the slider. Each of the second pressing parts may include a projecting step projecting in an inclined manner toward the housing in the second direction. A position of at least one of the second pressing parts may be shifted in the second direction with respect to positions of the other second pressing parts. In this case, when the slider moves in the second direction by a predetermined amount, the at least one second pressing part presses the corresponding one of the pressed parts downward. When the slider further moves in the second direction by a predetermined amount, the other second pressing parts further press the corresponding pressed parts downward.

In one or more embodiments of the disclosure, in the above switch device, at least one of the second pressing parts may constantly press the corresponding one of the pressed parts and the corresponding one of the first pressing parts may constantly press the corresponding one of the linear parts so that at least one pair of the movable contacts and the stationary contacts is a normally closed contact and the stationary contact may be connected to ground. The other pairs of the movable contacts and the stationary contacts may be normally open contacts and the stationary contacts may be connected to a power source.

In one or more embodiments of the disclosure, the above switch device may further include a plurality of operation knobs configured to swing. The movable contact of the normally closed contact may slide against the stationary contact in conjunction with an operation of at least a most frequently operated one of the operation knobs.

The disclosure makes it possible to provide a switch device that enables downsizing of a substrate.

BRIEF DESCRIPTION OF THE DRAWINGS

FIGS. 12B(b') and 12B(c) are sectional views taken along line D-D of FIG. 3 in an opening operation.

DETAILED DESCRIPTION

Figure 1:
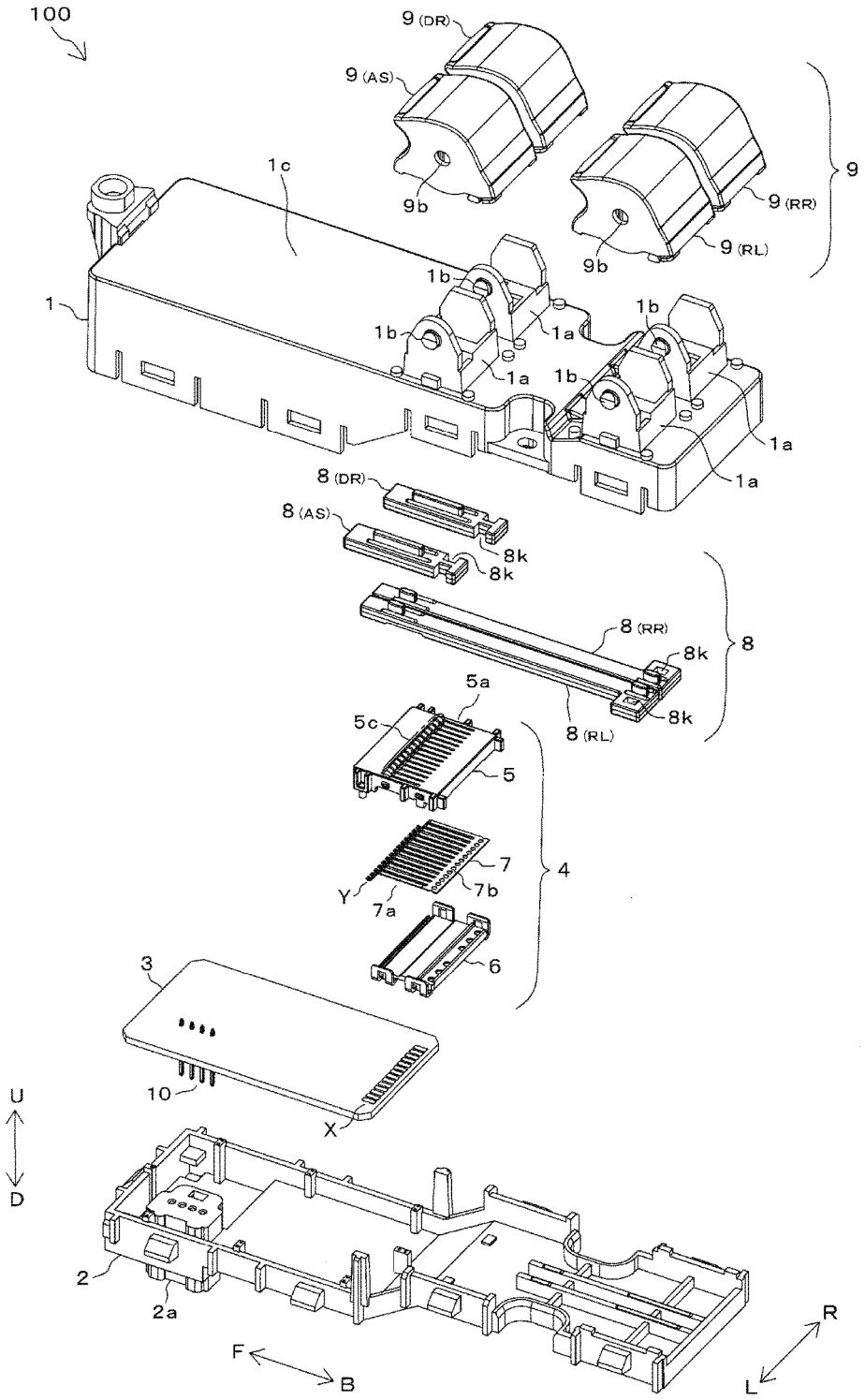
FIG. 1 is an exploded perspective view of a switch device according to one or more embodiments of the disclosure.

Embodiments of the disclosure will be described with reference to the drawings. In the drawings, the identical or equivalent component is designated by the identical numeral. In embodiments of the disclosure, numerous specific details are set forth in order to provide a more through understanding of the invention. However, it will be apparent to one of ordinary skill in the art that the invention may be practiced without these specific details. In other instances, well-known features have not been described in detail to avoid obscuring the invention.

First, the structure of a switch device 100 according to one or more embodiments of the disclosure will be described with reference to FIGS. 1 to 16(*e*).

Figure 2:
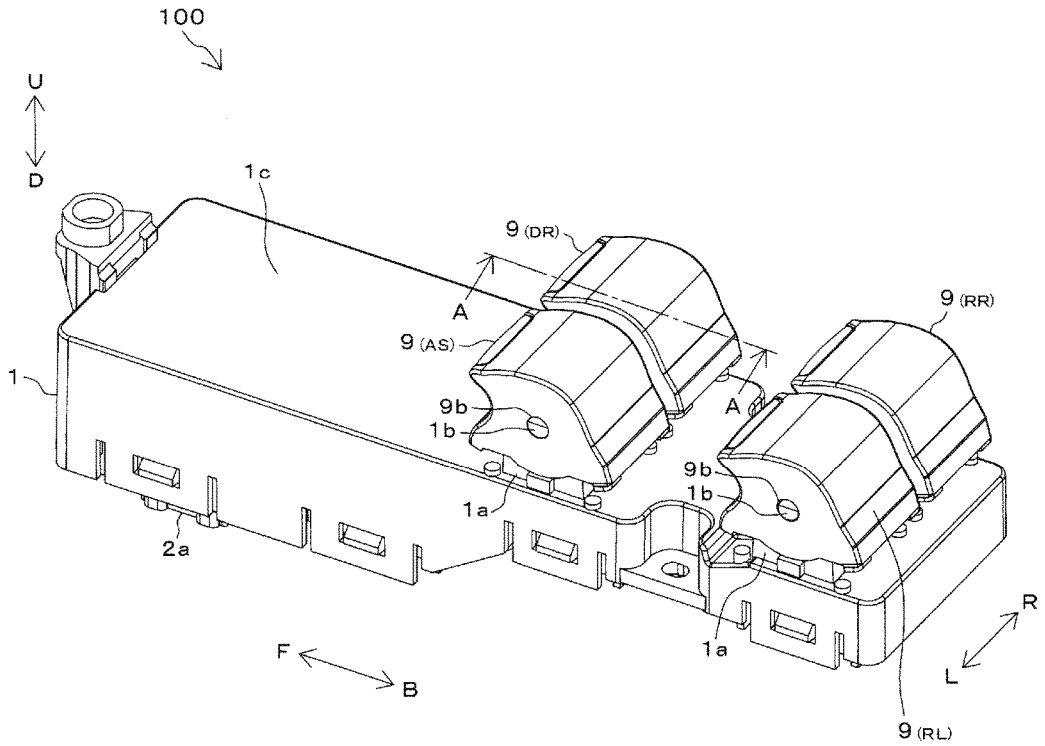
FIG. 2 is an assembled perspective view of the switch device of FIG. 1.
Figure 3:
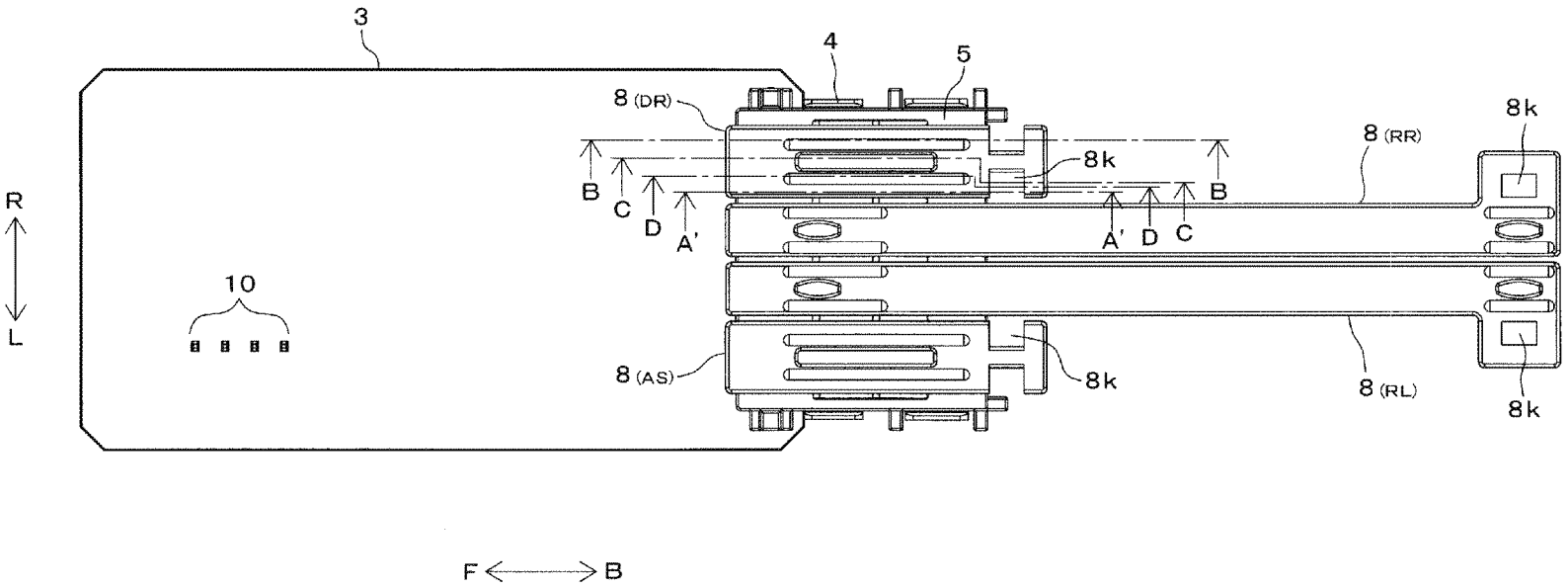
FIG. 3 is an assembled plan view of a substrate, a contact module, and sliders of FIG. 1.
Figure 4:
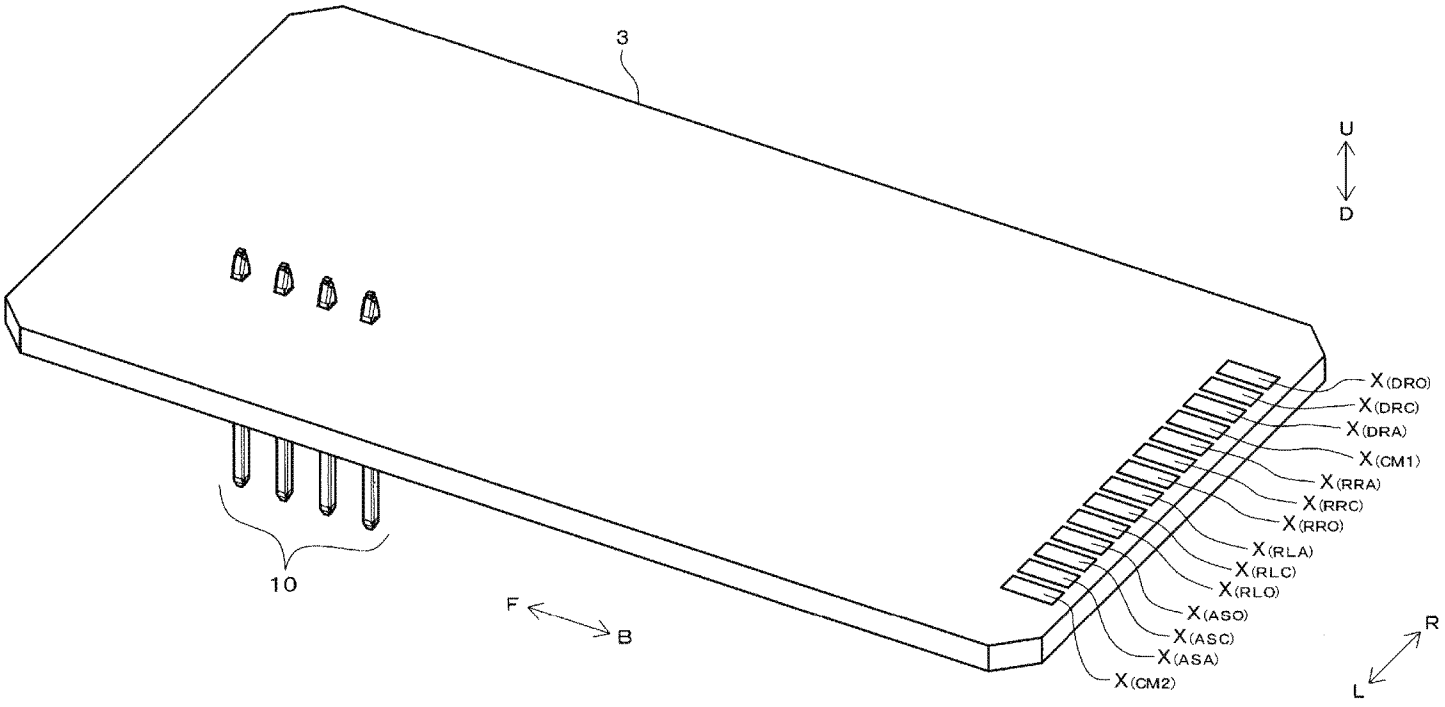
FIG. 4 is a perspective view of the substrate of FIG. 1.
Figure 5:
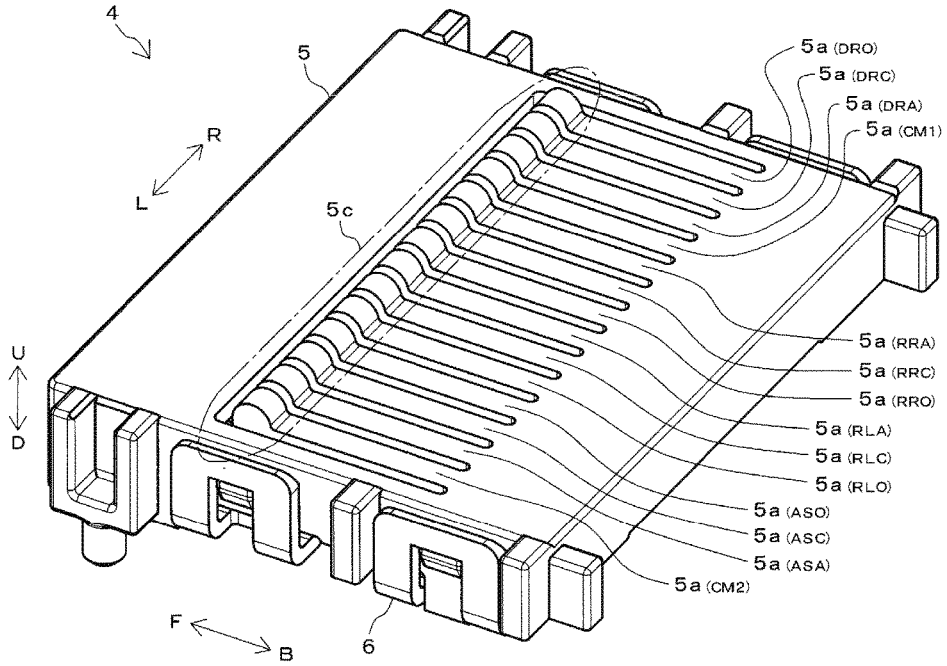
FIG. 5 is an assembled perspective view of the contact module of FIG. 1.
Figure 6:
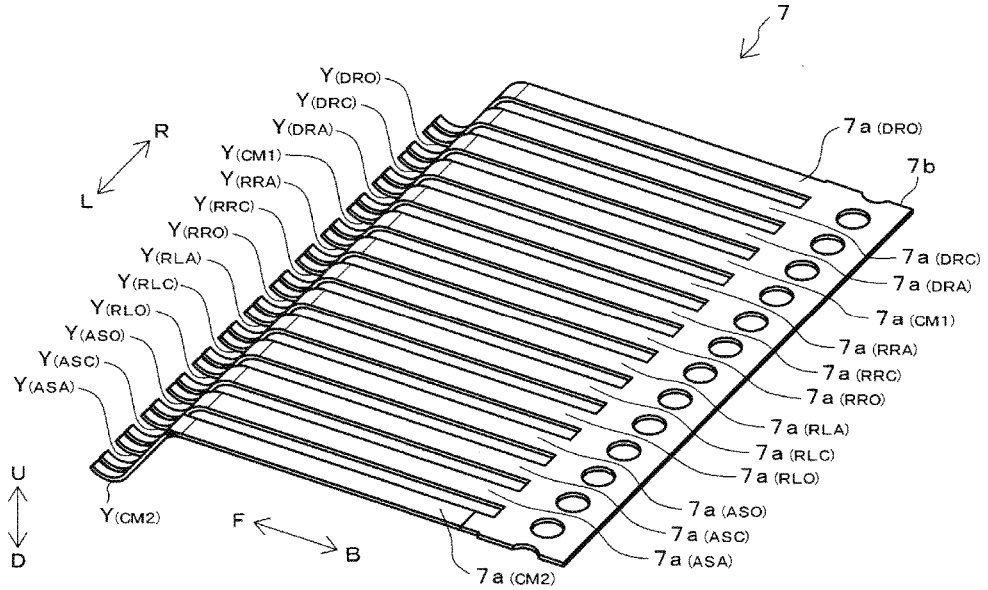
FIG. 6 is a perspective view of a contact of FIG. 1.
Figure 7:
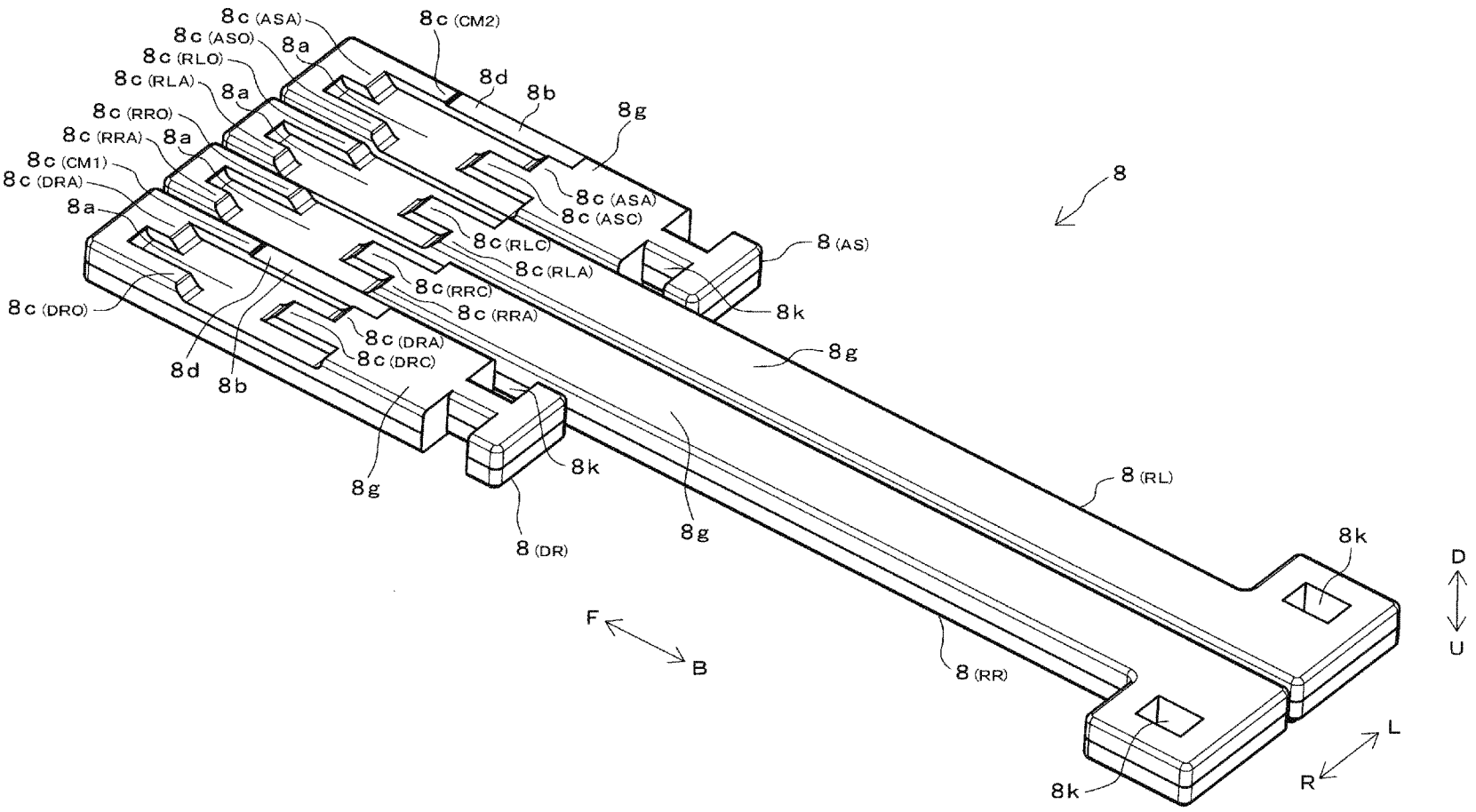
FIG. 7 is a perspective view of the sliders of FIG. 1 viewed from the back side.
Figure 8:
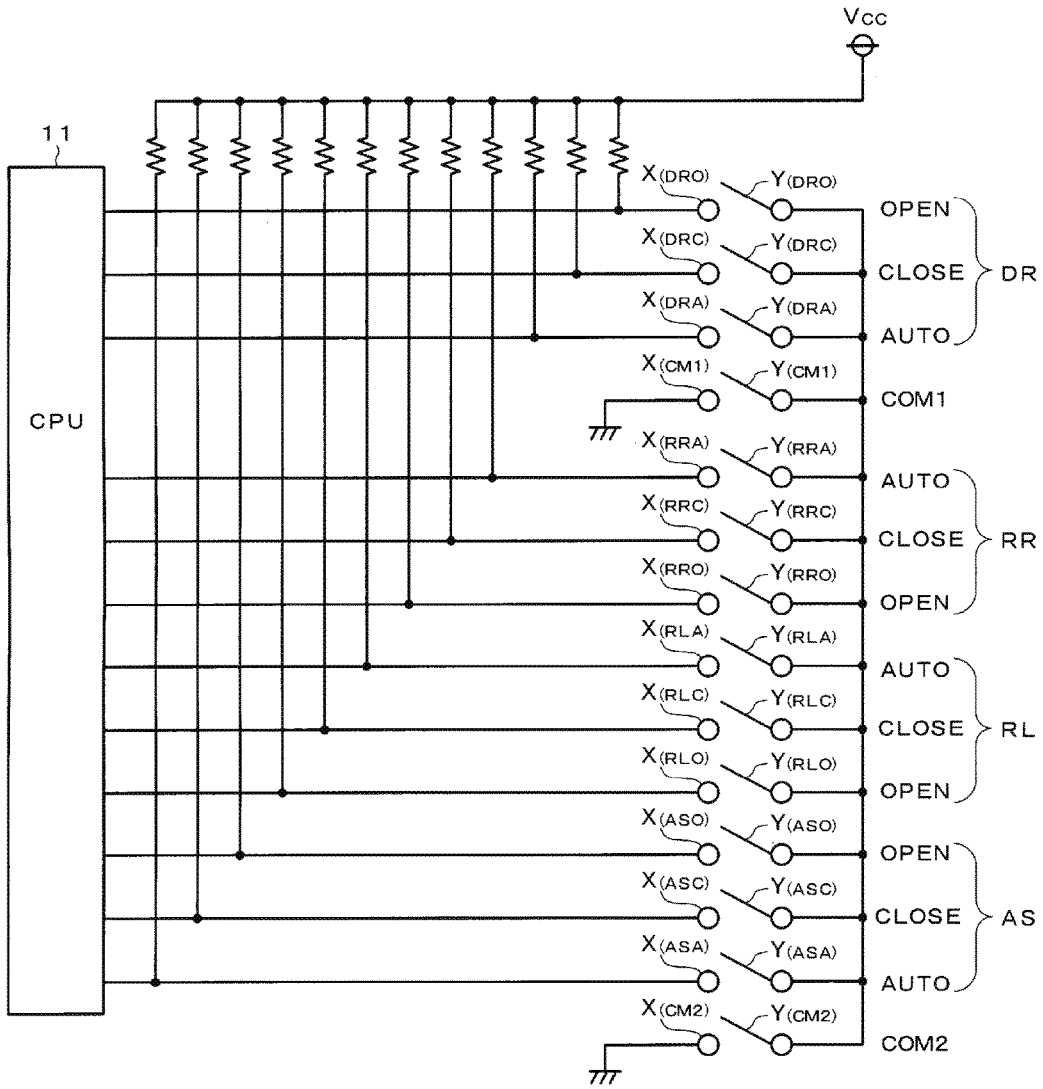
FIG. 8 is an electric circuit diagram of the switch device of FIG. 1.
Figure 9A:
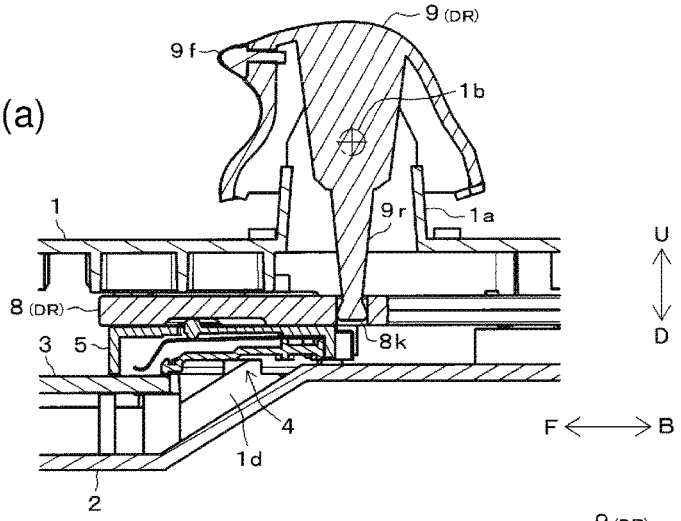
FIGS. 9(*a*) to 9(*c*) are sectional views taken along line A-A of FIG. 2 in a neutral state and an opening operation.
Figure 9B:
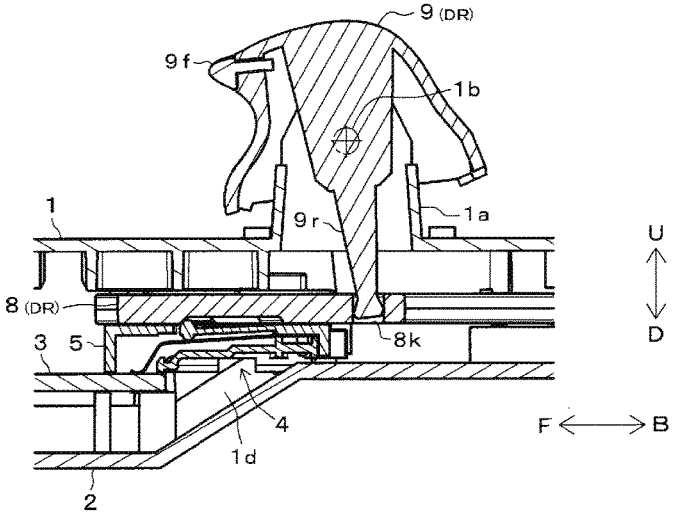
Figure 9C:
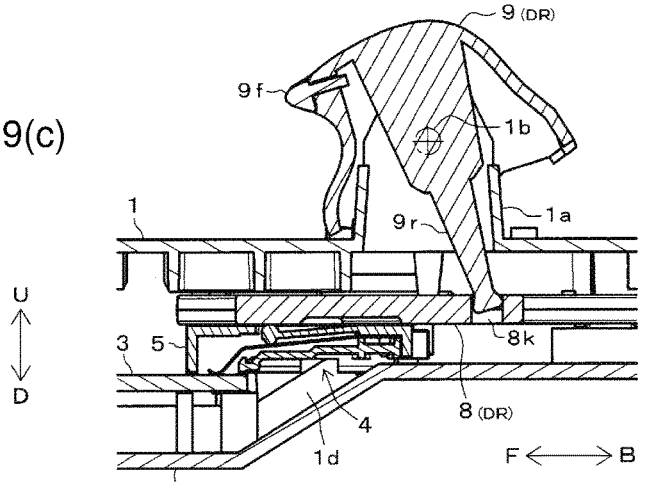
Figure 10A:
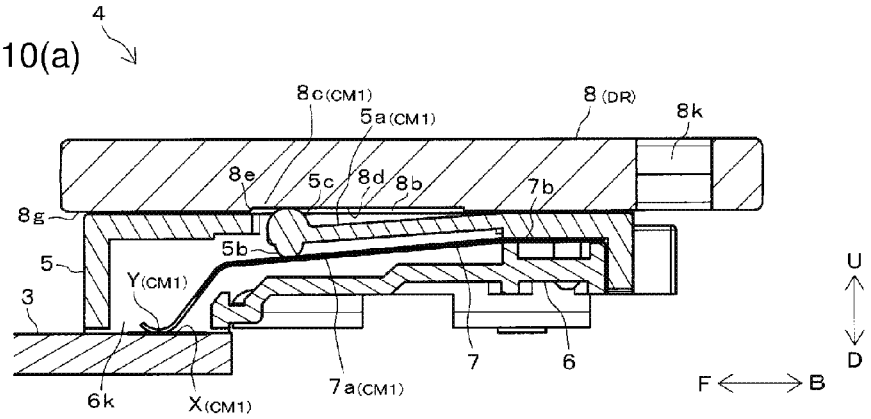
FIGS. 10(*a*) to 10(*c*) are sectional views taken along line A'-A' of FIG. 3 in a neutral state and an opening operation.
Figure 10B:
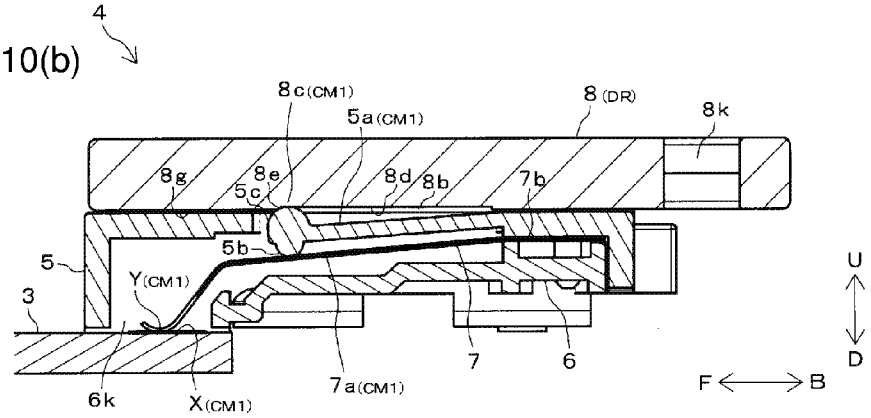
Figure 10C:
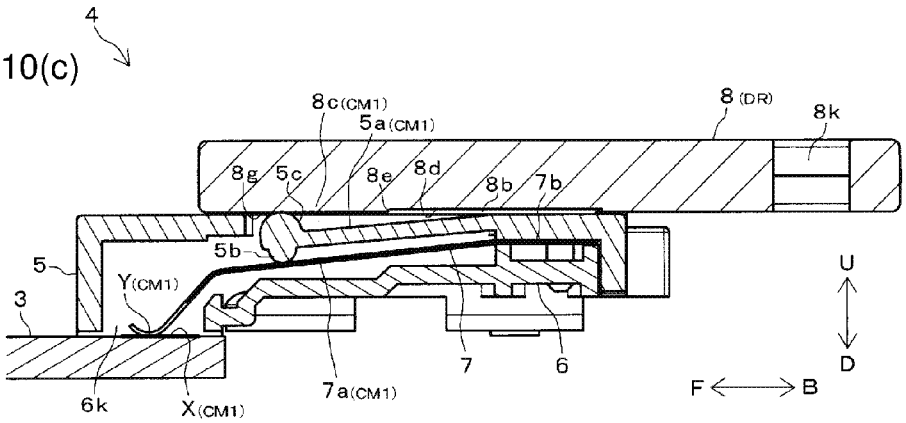
Figure 11A:
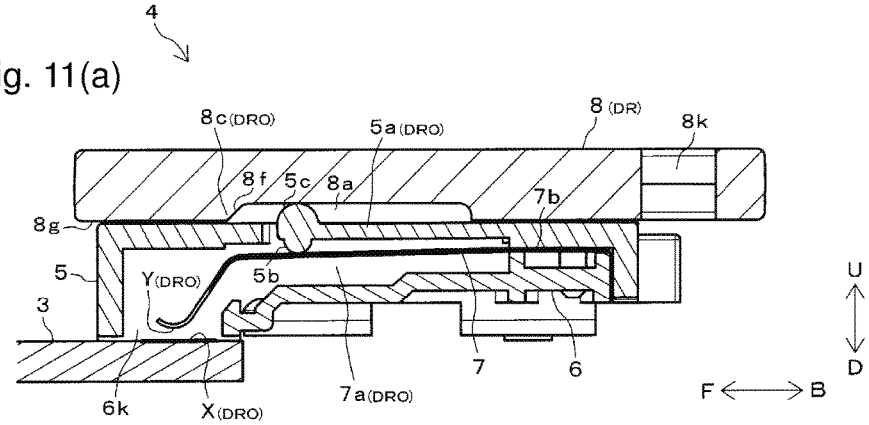
FIGS. 11(*a*) to 11(*c*) are sectional views taken along line B-B of FIG. 3 in a neutral state and an opening operation.
Figure 11B:
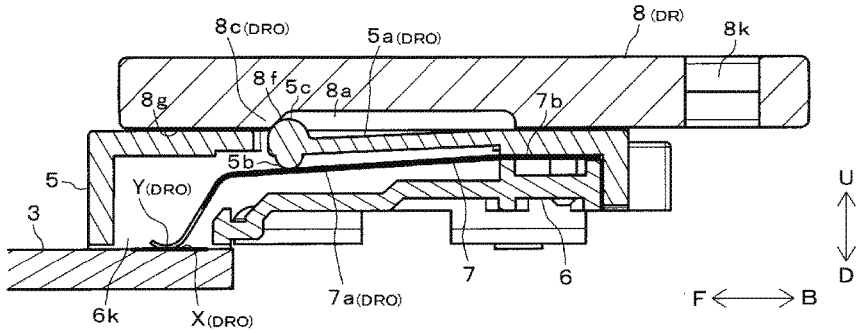
Figure 11C:
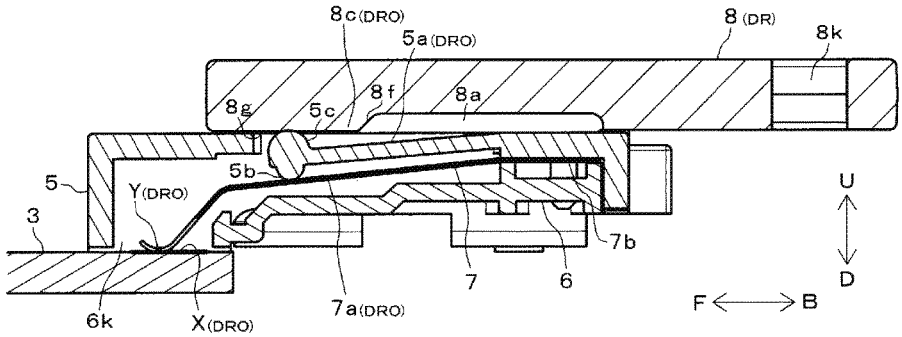
Figure 12A:
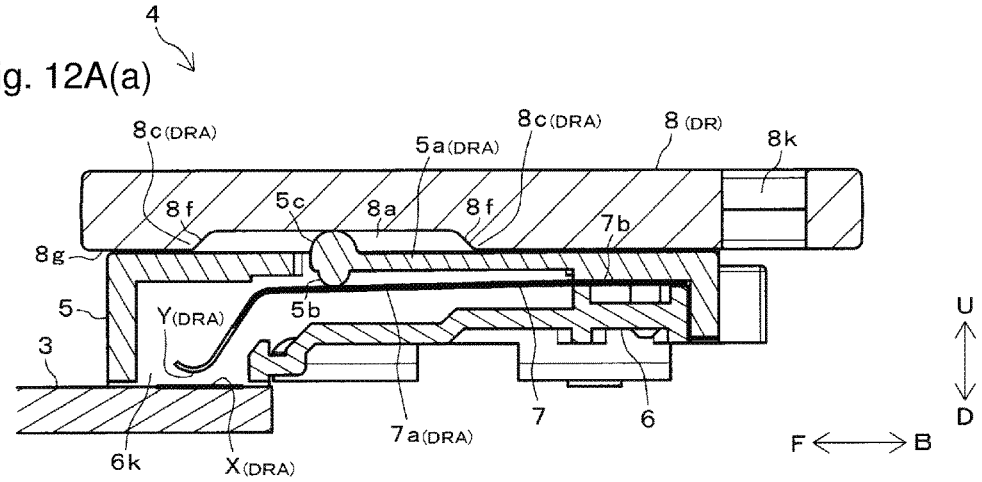
FIGS. 12A(a) and 12A(b) are sectional views taken along line D-D of FIG. 3 in a neutral state and an opening operation.
Figure 12A:
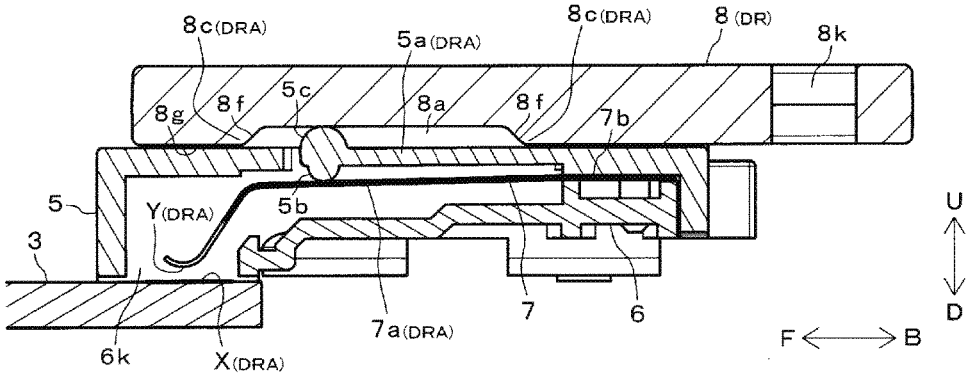

FIG. 1 is an exploded perspective view of the switch device 100. FIG. 2 is an assembled perspective view of the switch device 100. FIG. 3 is an assembled plan view of a substrate 3, a contact module 4, and sliders 8 of FIG. 1. FIG. 4 is a perspective view of the substrate 3 of FIG. 1. FIG. 5 is an assembled perspective view of the contact module 4 of FIG. 1. FIG. 6 is a perspective view of a contact 7 of FIG. 1. FIG. 7 is a perspective view of the sliders 8 of FIG. 1 viewed from the back side. FIG. 8 is an electric circuit diagram of the switch device 100. FIGS. 9(*a*) to 9(*c*) and FIGS. 13(*d*) and 13(*e*) are sectional views taken along line A-A of FIG. 2. FIGS. 10(*a*) to 10(*c*) and FIGS. 14(*d*) and 14(*e*) are perspective views taken along line A-A' of FIG. 3. FIGS. 11(*a*) to 11(*c*) are sectional views taken along line B-B of FIG. 3. FIGS. 12A(a) ad 12A(b), FIGS. 12B(b') and 12B(c), and FIGS. 16(*d*), 16(*d'*), and 16(*e*) are sectional views taken along line D-D of FIG. 3. FIGS. 15(*a*), 15(*d*), and 15(*e*) are sectional views taken along line C-C of FIG. 3. The A-A section of FIGS. 9(*a*) to 9(*c*) and FIGS. 13(*d*) and 13(*e*) and the A'-A' section of FIGS. 10(*a*) to 10(*c*) and FIGS. 14(*d*) and 14(*e*) are the same plane.

The switch device 100 illustrated in FIGS. 1 and 2 is a power window switch module mounted on an automatic four-wheel vehicle. The switch device 100 is used for opening and closing windows at a driver seat, a passenger seat, a right back seat, and a left back seat of the automatic four-wheel vehicle and disposed on an armrest near the driver seat.

The switch device 100 is provided with an upper case 1, a lower cover 2, a substrate 3, a contact module 4, a slider 8, and an operation knob 9 illustrated in FIG. 1. The upper case 1, the lower cover 2, housings 5, 6 of the contact module 4, the slider 8, and the operation knob 9 are formed of synthetic resin. The substrate 3 includes, for example, a glass epoxy substrate. A contact 7 of the contact module 4 is formed of a conductive metal such as copper.

The upper case 1 is formed in a substantially box-like shape and open downward. As illustrated in FIG. 2, the lower cover 2 is fitted with the lower part of the upper case 1 to close an opening part of the upper case 1. As illustrated in FIG. 1, a connector part 2*a* is formed on the lower part of the lower cover 2 in a manner to project downward.

Four knob attachment parts 1*a* are formed on the upper part of the upper case 1. The inner side of each of the knob attachment parts 1*a* is open so as to communicate with the inside of the upper case 1 (FIGS. 9(*a*) to 9(*c*) and FIGS. 13(*d*) and 13(*e*)). Four operation knobs 9 are attached to the respective knob attachment parts 1*a* to cover the respective knob attachment parts 1*a* from an upper side U.

Specifically, support shafts 1*b* which are disposed on right and left side faces of each of the knob attachment parts 1*a* are engaged with shaft holes 9*b* which are formed on right and left side faces of the corresponding one of the operation knobs 9. Accordingly, each of the operation knobs 9 is attached to the corresponding one of the knob attachment parts 1*a* as illustrated in FIG. 2. The support shafts 1*b* are parallel to a left-right direction L, R. Thus, each of the operation knobs 9 is swingable around the support shafts 1 b in opening and closing directions (in counterclockwise and clockwise directions in FIGS. 9(*a*) to 9(*c*) and FIGS. 13(*d*) and 13(*e*)). Each of the operation knobs 9 is held in a neutral state when not operated and swingable in two stages in each of the opening and closing directions by a click mechanism (not illustrated).

In FIG. 2, an operation knob $\mathbf{9}_{(DR)}$ is operated to open and close the window at the driver seat (right front seat). An operation knob $\mathbf{9}_{(AS)}$ is operated to open and close the window at the passenger seat (left front seat). An operation knob $\mathbf{9}_{(RR)}$ is operated to open and close the window at the right back seat. An operation knob $\mathbf{9}_{(RL)}$ is operated to open and close the window at the left back seat. Among these operation knobs 9, the operation knob $\mathbf{9}_{(DR)}$ for the window at the driver seat is the most frequently operated one. The operation knob $\mathbf{9}_{(AS)}$ for the window at the passenger seat is generally the second most frequently operated one.

As illustrated in FIGS. 1 and 2, an upper face 1*c* of the upper case 1 is flat except for the knob attachment parts 1*a*. On the other hand, the lower part of the upper case 1 has a two-stage shape. Specifically, the height (thickness) in a downward direction D of a back part (a part corresponding to the B direction side) of the upper case 1 on which the knob attachment parts 1*a* are disposed is lower than the height in the downward direction D of a front part (a part corresponding to the F direction side) of the upper case 1. A back part of the lower cover 2 rises higher toward the upper side U than a front part thereof corresponding to the shape of the upper case 1.

Figure 13D:
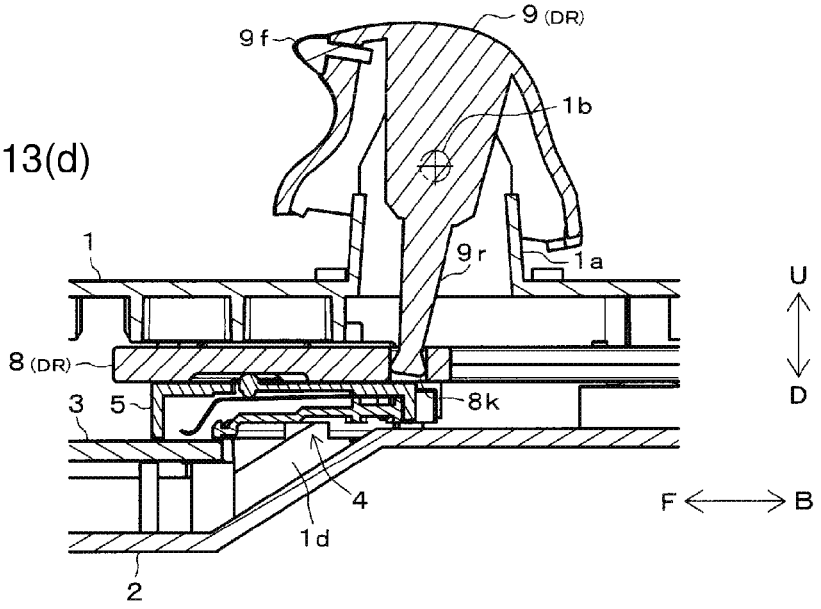
FIGS. 13(*d*) and 13(*e*) are sectional views taken along line A-A of FIG. 2 in a closing operation.
Figure 13E:
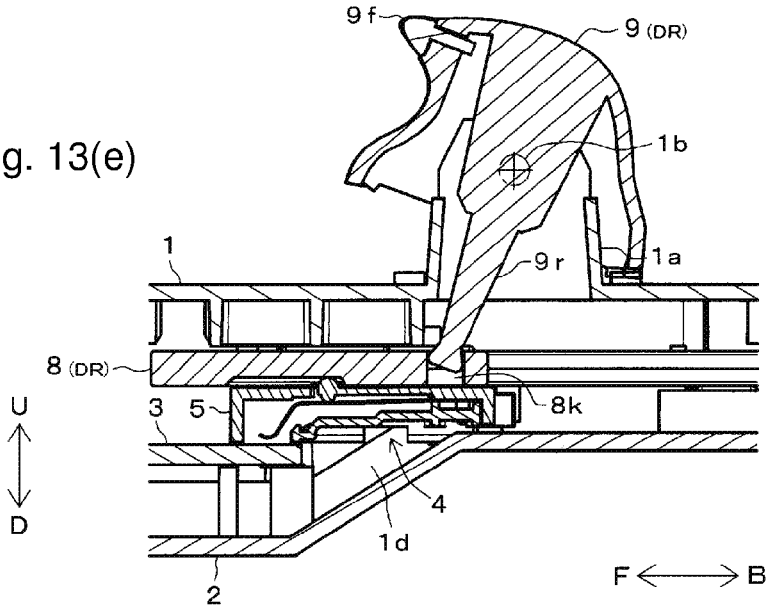

The substrate 3 of FIG. 1 is housed inside the higher front part of the upper case 1 (FIGS. 9(*a*) to 9(*c*) and FIGS. 13(*d*) and 13(*e*)). In the assembled state of FIG. 2, the substrate 3 is fixed, for example, on the lower cover 2 with a screw. A plurality of connector terminals 10 (FIG. 1) are mounted on a front part of the substrate 3. Each of the connector terminals 10 is engaged with the connector part 2*a* of the lower cover 2.

A plurality of (fourteen) stationary contacts X are disposed side by side in a row in the left-right direction L, R (first direction) on a back end (the B direction side) of the upper face of the substrate 3. Each of the stationary contacts X includes copper foil.

As illustrated in FIG. 4, the first three from the right side R to the left side L of the substrate 3 are an opening stationary contact $X_{(DRO)}$, a closing stationary contact $X_{(DRC)}$, and an automation stationary contact $X_{(DRA)}$ for the window at the driver seat. The next one is a first common stationary contact $X_{(CM1)}$. The next three are an automation stationary contact $X_{(RRA)}$, a closing stationary contact $X_{(RRC)}$, and an opening stationary contact $X_{(RRO)}$ for the window at the right back seat. The next three are an automation stationary contact $X_{(RLA)}$, a closing stationary contact $X_{(RLC)}$, and an opening stationary contact $X_{(RLO)}$ for the window at the left back seat. The next three are an opening stationary contact $X_{(ASO)}$, a closing stationary contact $X_{(ASC)}$, and an automation stationary contact $X_{(ASA)}$ for the window at the passenger seat. The one located at the most left side L is a second common stationary contact $X_{(CM2)}$.

The contact module 4 illustrated in FIG. 1 includes the housings 5, 6 of a two-piece structure and the contact 7.

The contact 7 is formed in a comb-like shape and includes a plurality of (fourteen) linear parts 7*a* (parts corresponding to comb teeth) having elasticity as illustrated in FIG. 6. Each of the linear parts 7*a* is formed in a cantilever shape. The linear parts 7*a* are connected to each other in a base 7*b*. The tip side of each of the linear parts 7*a* is bent in the downward direction D (FIGS. 10(*a*) to 10(*c*)) and has a movable contact Y formed on the lower face of the tip thereof. Each movable contact Y is formed in a circular arc shape projecting in the downward direction D. The plurality of (fourteen) linear parts 7*a* and a plurality of (fourteen) movable contacts Y are provided corresponding one-to-one to the stationary contacts X on the substrate 3.

As illustrated in FIG. 6, the first three from the right side R to the left side L of the contact 7 are an opening linear part $\mathbf{7}a_{(DRO)}$ and an opening movable contact $Y_{(DRO)}$, a closing linear part $\mathbf{7}a_{(DRC)}$ and a closing movable contact $Y_{(DRC)}$, and an automation linear part $\mathbf{7}a_{(DRA)}$ and an automation movable contact $Y_{(DRA)}$ for the window at the driver seat. The next one is a first common linear part $\mathbf{7}a_{(CM1)}$ and a first common movable contact $Y_{(CM1)}$. The next three are an automation linear part $\mathbf{7}a_{(RRA)}$ and an automation movable contact $Y_{(RRA)}$, a closing linear part $\mathbf{7}a_{(RRC)}$ and a closing movable contact $Y_{(RRC)}$, and an opening linear part $\mathbf{7}a_{(RRO)}$ and an opening movable contact $Y_{(RRO)}$ for the window at the right back seat. The next three are an automation linear part $\mathbf{7}a_{(RLA)}$ and an automation movable contact $Y_{(RLA)}$, a closing linear part $\mathbf{7}a_{(RLC)}$ and a closing movable contact $Y_{(RLC)}$, and an opening linear part $\mathbf{7}a_{(RLO)}$ and an opening movable contact $Y_{(RLO)}$ for the window at the left back seat. The next three are an opening linear part $\mathbf{7}a_{(ASO)}$ and an opening movable contact $Y_{(ASO)}$, a closing linear part $\mathbf{7}a_{(ASC)}$ and a closing movable contact $Y_{(ASC)}$, and an automation linear part $\mathbf{7}a_{(ASA)}$ and an automation movable contact $Y_{(ASA)}$ for the window at the passenger seat. The one located on the most left side L is a second common linear part $\mathbf{7}a_{(CM2)}$ and a second common movable contact $Y_{(CM2)}$.

As illustrated in FIG. 8, in view of an electric circuit, an opening operation electric switch for the window DR at the driver seat includes the stationary contact $X_{(DRO)}$ and the movable contact $Y_{(DRO)}$. A closing operation electric switch for the window DR at the driver seat includes the stationary contact $X_{(DRC)}$ and the movable contact $Y_{(RRC)}$. An automatic operation electric switch for the window DR at the driver seat includes the stationary contact $X_{(RRA)}$ and the movable contact $Y_{(DRA)}$. An automatic operation electric switch for the window RR at the right back seat includes the stationary contact $X_{(RRA)}$ and the movable contact $Y_{(RRA)}$. A closing operation electric switch for the window RR at the right back seat includes the stationary contact $X_{(RRC)}$ and the movable contact $Y_{(RRC)}$. An opening operation electric switch for the window RR at the right back seat includes the stationary contact $X_{(RRO)}$ and the movable contact $Y_{(RRO)}$. An automatic operation electric switch for the window RL at the left back seat includes the stationary contact $X_{(RLA)}$ and the movable contact $Y_{(RLA)}$. A closing operation electric switch for the window RL at the left back seat includes the stationary contact $X_{(RLC)}$ and the movable contact $Y_{(RLC)}$. An opening operation electric switch for the window RL at the left back seat includes the stationary contact $X_{(RLO)}$ and the movable contact $Y_{(RLO)}$. An opening operation electric switch for the window AS at the passenger seat includes the stationary contact $X_{(ASO)}$ and the movable contact $Y_{(ASO)}$. A closing operation electric switch for the window AS at the passenger seat includes the stationary contact $X_{(ASC)}$ and the movable contact $Y_{(ASC)}$. An automatic operation electric switch for the window AS at the passenger seat includes the stationary contact $X_{(ASA)}$ and the movable contact $Y_{(ASA)}$. A first common electric switch includes the stationary contact $X_{(CM1)}$ and the movable contact $Y_{(CM1)}$. A second common electric switch includes the stationary contact $X_{(CM2)}$ and the movable contact $Y_{(CM2)}$.

The movable contacts Y are electrically connected to each other. The common stationary contacts $X_{(CM1)}$, $X_{(CM2)}$ are connected to ground. The other stationary contacts X are connected to a CPU 11 and connected to a power source $V_{CC}$ through a resistor. The CPU 11 is mounted on the substrate 3 and detects an open/closed state of each of the stationary and movable contacts X, Y to determine an opening/closing operation state for each of the windows. The CPU 11 drives an electric motor corresponding to each of the windows on the basis of the opening/closing operation state for the window to open or close a window glass of the window.

The upper housing 5 and the lower housing 6 illustrated in FIG. 1 are combined as illustrated in FIG. 5 and hold the contact 7 inside thereof. Specifically, as illustrated in FIGS. 10(*a*) to 10(*c*), the upper housing 5 and the lower housing 6 sandwich the base 7*b* of the contact 7 therebetween from the upper and lower sides to hold the base 7*b*. In this state of the contact module 4 assembled in this manner, each of the movable contacts Y of the contact 7 is exposed through an opening 6k which is open in the downward direction D of the housings 5, 6.

As illustrated in FIG. 5, a plurality of beams 5*a* having elasticity are disposed on the upper part of the upper housing 5. Each of the beams 5*a* is formed in a cantilever shape. The beams 5*a* are connected to each other on their bases. Each of the beams 5*a* is disposed on the upper side U of the corresponding one of the linear parts 7*a* of the contact 7 in parallel to the linear parts 7*a* (FIGS. 10(*a*) to 10(*c*)). That is, a plurality of (fourteen) beams 5*a* are provided corresponding one-to-one to the linear parts 7*a*.

As illustrated in FIG. 5, the first three from the right side R to the left side L of the upper housing 5 are an opening beam $5a_{(DRO)}$, a closing beam $5a_{(DRC)}$, and an automation beam $5a_{(DRA)}$ for the window at the driver seat. The next one is a first common beam $5a_{(CM1)}$. The next three are an automation beam $5a_{(RRA)}$, a closing beam $5a_{(RRC)}$, and an opening beam $5a_{(RRO)}$ for the window at the right back seat. The next three are an automation beam $5a_{(RLA)}$, a closing beam $5a_{(RLC)}$, and an opening beam $5a_{(RLO)}$ for the window at the left back seat. The next three are an opening beam $5a_{(ASO)}$, a closing beam $5a_{(ASC)}$, and an automation beam $5a_{(ASA)}$ for the window at the passenger seat. The one located on the most left side L is a second common beam $5a_{(CM2)}$.

As illustrated in FIGS. 10(*a*) to 10(*c*), a first pressing part 5*b* for pressing an intermediate part of the corresponding one of the linear parts 7*a* in the downward direction D is formed on the lower face of the tip of each of the beams 5*a*. The first pressing part 5*b* includes a projecting curved surface projecting toward the contact 7. A pressed part 5*c* is formed on the upper face of the tip of each of the beams 5*a*. The pressed part 5*c* includes a projecting curved surface projecting toward the slider 8.

As illustrated in FIGS. 9(*a*) to 9(*c*), the contact module 4 is housed inside a step 1*d* of the case 1. In this housed state, the housings 5, 6 are fixed on the lower cover 2. Each of the movable contacts Y of the contact 7 faces the corresponding one of the stationary contacts X at the upper side U of the substrate 3. Each of the stationary contacts X and each of the movable contacts Y are disposed at positions that are off a position directly under each of the operation knobs 9 in the front-back direction F, B.

As illustrated in FIG. 1, a plurality of (four) sliders 8 are provided corresponding one-to-one to the operation knobs 9. The length in the front-back direction F, B of a slider $8_{(DR)}$ corresponding to the operation knob $9_{(DR)}$ for the window at the driver seat and a slider $8_{(AS)}$ corresponding to the operation knob $9_{(AS)}$ for the window at the passenger seat is shorter than the length in the front-back direction F, B of a slider $8_{(RR)}$ corresponding to the operation knob $9_{(RR)}$ for the window at the right back seat and a slider $8_{(RL)}$ corresponding to the operation knob $9_{(RL)}$ for the window at the left back seat.

As illustrated in FIGS. 9(*a*) to 9(*c*), each of the sliders 8 is housed inside the upper case 1 in a manner to extend from a position directly under the corresponding one of the operation knobs 9 to a position directly above the upper housing 5. The upper housing 5 and the upper case 1 restrict movement of the short sliders $8_{(DR)}$, $8_{(AS)}$ in the up-down directions U, D and the left-right direction L, R. The upper housing 5, the lower cover 2, and the upper case 1 restrict movement of the long sliders $8_{(RR)}$, $8_{(RL)}$ in the up-down directions U, D and the left-right direction L, R. That is, each of the sliders 8 is movable only in the front-back direction F, B.

As illustrated in FIG. 7, a recess 8*k* which includes a cut-away part is formed on a back end part (an end part corresponding to the B direction side) of each of the sliders $8_{(DR)}$, $8_{(AS)}$. A recess 8*k* which includes a through hole is formed on a back end part of each of the sliders $8_{(RR)}$, $8_{(RL)}$. As illustrated in FIGS. 9(*a*) to 9(*c*), a lever 9*r* is formed inside each of the operation knobs 9. In this example, the lever 9*r* is integrated with the operation knob 9. The upper end of the lever 9*r* is integrally coupled to the operation knob 9. The lower end of the lever 9*r* projects into the upper case 1, and engaged with the recess 8*k* of the corresponding one of the sliders 8 so as to be coupled to the slider 8. Thus, as illustrated in FIGS. 9(*a*) to 9(*c*) and 13(*d*) and 13(*e*), when each of the operation knobs 9 is operated with a finger to swing, the lever 9*r* thereof turns around the support shafts 1*b*, which reciprocates the corresponding one of the sliders 8 in the front-back direction F, B (second direction).

As illustrated in FIG. 7, a recess 8*a* is formed on a lower face 8*g* of each of the sliders 8 at a front side (F direction side). The pressed parts 5*c* of adjacent three of the beams 5*a* on the upper housing 5 are fitted into each of the recesses 8*a* (FIGS. 11(*a*) to (*c*)).

Each end in the front-back direction F, B of each of the recesses 8*a* is divided into three parts in the left-right direction L, R so as to correspond one-to-one to the beams 5*a*. As illustrated in FIGS. 11(*a*) to 11(*c*), each of the divided ends forms a projecting step 8$c$ projecting in an inclined manner toward the upper housing 5 (the lower side D) from the center of the recess 8$a$ in the front-back direction F, B. The positions of projecting steps 8$c$ continuous with the same recess 8$a$ are shifted from each other in the front-back direction F, B.

As illustrated in FIG. 7, in the slider $\mathbf{8}_{(DR)}$ for the window at the drive seat, projecting steps $\mathbf{8}c_{(DRO)}$, $\mathbf{8}c_{(DRC)}$, and $\mathbf{8}c_{(DRA)}$ respectively correspond to an opening second pressing part, a closing second pressing part, and an automation second pressing part for the window at the driver seat. In the slider $\mathbf{8}_{(RR)}$ for the window at the right back seat, projecting steps $\mathbf{8}c_{(RRO)}$, $\mathbf{8}c_{(RRC)}$, and $\mathbf{8}c_{(RRA)}$ respectively correspond to an opening second pressing part, a closing second pressing part, and an automation second pressing part for the window at the right back seat. In the slider $\mathbf{8}_{(RL)}$ for the window at the left back seat, projecting steps $\mathbf{8}c_{(RLO)}$, $\mathbf{8}c_{(RLC)}$, and $\mathbf{8}c_{(RLA)}$ respectively correspond to an opening second pressing part, a closing second pressing part, and an automation second pressing part for the window at the left back seat. In the slider $\mathbf{8}_{(AS)}$ for the window at the passenger seat, projecting steps $\mathbf{8}c_{(ASO)}$, $\mathbf{8}c_{(ASC)}$, and $\mathbf{8}c_{(ASA)}$ respectively correspond to an opening second pressing part, a closing second pressing part, and an automation second pressing part for the window at the passenger seat. The positions of the opening second pressing parts $\mathbf{8}c_{(DRO)}$, $\mathbf{8}c_{(ASO)}$, $\mathbf{8}c_{(RRO)}$, $\mathbf{8}c_{(RLO)}$, the closing second pressing parts $\mathbf{8}c_{(DRC)}$, $\mathbf{8}c_{(ASC)}$, $\mathbf{8}c_{(RRC)}$, $\mathbf{8}c_{(RLC)}$, and the automation second pressing parts $\mathbf{8}c_{(DRA)}$, $\mathbf{8}c_{(ASA)}$, $\mathbf{8}c_{(RRA)}$, $\mathbf{8}c_{(RLA)}$ are shifted from each other in the front-back direction F, B.

A recess 8$b$ is formed on the left side L of the recess 8$a$ of each of the sliders $\mathbf{8}_{(DR)}$, $\mathbf{8}_{(AS)}$ for the windows at the driver and passenger seats. Based on the lower face 8$g$ of each of the sliders $\mathbf{8}_{(DR)}$, $\mathbf{8}_{(AS)}$, the recess 8$b$ is deeper than the recess 8$a$. A projecting step projecting in an inclined manner toward the upper housing 5 (the lower side D) in the front-back direction F, B is formed on an end on the front side F of each of the recesses 8$b$. Bottom faces 8$d$ of the recesses 8$b$ continuous with the projecting steps correspond to common second pressing parts $\mathbf{8}c_{(CM1)}$, $\mathbf{8}c_{(CM2)}$. The positions of the common second pressing parts $\mathbf{8}c_{(CM1)}$, $\mathbf{8}c_{(CM2)}$ are shifted with respect to the positions of the other second pressing parts 8$c$ in the front-back direction F, B.

When each of the sliders 8 moves in the front-back direction F, B, the second pressing parts 8$c$ thereof press the pressed parts 5$c$ of the corresponding beams 5$a$ of the housing 5 downward (FIGS. 9($a$) to 16($e$)).

Next, the operation of the switch device 100 will be described with reference to FIGS. 9($a$) to 16($e$).

Hereinbelow, there will be described, as an example, operations of the operation knob $\mathbf{9}_{(DR)}$, the slider $\mathbf{8}_{(DR)}$, the beams $\mathbf{5}a_{(CM1)}$, $\mathbf{5}a_{(DRC)}$, $\mathbf{5}a_{(DRO)}$, $\mathbf{5}a_{(DRA)}$, the linear parts $\mathbf{7}a_{(CM1)}$, $\mathbf{7}a_{(DRC)}$, $\mathbf{7}a_{(DRO)}$, $\mathbf{7}a_{(DRA)}$, the movable contacts $Y_{(CM1)}$, $Y_{(DRC)}$, $Y_{(DRO)}$, $Y_{(DRA)}$, and the stationary contacts $X_{(CM1)}$, $X_{(DRC)}$, $X_{(DRO)}$, $X_{(DRA)}$ for the window at the driver seat. Operations of the parts for the windows at the other seats are the same as the operations described below.

<Non-Operation>

As illustrated in FIG. 9($a$), when the operation knob $\mathbf{9}_{(DR)}$ is in a neutral (non-operation) state, the lever 9$r$ is in a vertical attitude and the slider $\mathbf{8}_{(DR)}$ is in a neutral position.

In such a neutral state, as illustrated in FIG. 10($a$), the pressed part 5$c$ of the common beam $\mathbf{5}a_{(CM1)}$ of the upper housing 5 is fitted in the recess 8$b$ of the slider $\mathbf{8}_{(DR)}$. At this time, the pressed part 5$c$ of the common beam $\mathbf{5}a_{(CM1)}$ is pressed by the step lower surface 8$d$ (the bottom face of the recess 8$b$) of the common second pressing part $\mathbf{8}c_{(CM1)}$, and the common beam $\mathbf{5}a_{(CM1)}$ is thereby bent in the downward direction D. Accordingly, the first pressing part 5$b$ of the common beam $\mathbf{5}a_{(CM1)}$ presses the intermediate part of the common linear part $\mathbf{7}a_{(CM1)}$ of the contact 7, and the common linear part $\mathbf{7}a_{(CM1)}$ is thereby bent in the downward direction D. Thus, the common movable contact $Y_{(CM1)}$ located on the tip of the common linear part $\mathbf{7}a_{(CM1)}$ is in contact with the common stationary contact $X_{(CM1)}$ on the substrate 3. That is, the common movable contact $Y_{(CM1)}$ and the stationary contact $X_{(CM1)}$ are in a closed circuit state.

In the neutral state, as illustrated in FIGS. 11($a$), 15($a$), and 12A(a), the pressed parts 5$c$ of the opening beam $\mathbf{5}a_{(DRO)}$, the closing beam $\mathbf{5}a_{(DRC)}$, and the automation beam $\mathbf{5}a_{(DRA)}$ of the upper housing 5 are fitted in the recess 8$a$ of the slider $\mathbf{8}_{(DR)}$. At this time, each of the pressed parts 5$c$ is in contact with the bottom face of the recess 8$a$. However, the beams $\mathbf{5}a_{(DRO)}$, $\mathbf{5}a_{(DRC)}$, $\mathbf{5}a_{(DRA)}$ are not bent in the downward direction D. The first pressing part 5$b$ of the opening beam $\mathbf{5}a_{(DRO)}$ is in contact with the intermediate part of the opening linear part $\mathbf{7}a_{(DRO)}$ of the contact 7. The first pressing part 5$b$ of the closing beam $\mathbf{5}a_{(DRC)}$ is in contact with the intermediate part of the closing linear part $\mathbf{7}a_{(DRC)}$ of the contact 7. The first pressing part 5$b$ of the automation beam $\mathbf{5}a_{(DRA)}$ is in contact with the intermediate part of the automation linear part $\mathbf{7}a_{(DRA)}$ of the contact 7. However, the linear parts $\mathbf{7}a_{(DRO)}$, $\mathbf{7}a_{(DRC)}$, $\mathbf{7}a_{(DRA)}$ are not bent in the downward direction D. Thus, the opening movable contact $Y_{(DRO)}$ on the tip of the opening linear part $\mathbf{7}a_{(DRO)}$, the closing movable contact $Y_{(DRC)}$ on the tip of the closing linear part $\mathbf{7}a_{(DRC)}$, and the automation movable contact $Y_{(DRA)}$ on the tip of the automation linear part $\mathbf{7}a_{(DRA)}$ are respectively separated from the opening stationary contact $X_{(DRO)}$, the closing stationary contact $X_{(DRC)}$, and the automation stationary contact $X_{(DRA)}$ on the substrate 3. That is, the opening movable contact $Y_{(DRO)}$ and the opening stationary contact $X_{(DRO)}$ are in an open circuit state, the closing movable contact $Y_{(DRC)}$ and the closing stationary contact $X_{(DRC)}$ are in an open circuit state, and the automation movable contact $Y_{(DRA)}$ and the automation stationary contact $X_{(DRA)}$ are in an open circuit state.

In FIG. 8, as described above, when the common contacts $Y_{(CM1)}$, $X_{(CM1)}$ are in a closed circuit state and the other contacts $Y_{(DRO)}$, $X_{(DRO)}$, $Y_{(DRC)}$, $X_{(DRC)}$, $Y_{(DRA)}$, $X_{(DRA)}$ are in an open circuit state, the CPU 11 determines that no opening/closing operation for the window at the driver seat has been performed. Then, the CPU 11 does not open or close a window glass of the window at the driver seat and maintains a stopped state.

<Manual Opening Operation>

As illustrated in FIG. 9($b$), when a front head 9f of the operation knob $\mathbf{9}_{(DR)}$ is pushed down to operate the operation knob $\mathbf{9}_{(DR)}$ in an opening direction (the counterclockwise direction in FIG. 9($b$)) in a first stage, the lever 9$r$ turns in the opening direction along with the swing of the operation knob $\mathbf{9}_{(DR)}$ so as to tilt forward by a predetermined angle. Accordingly, the back part of the slider $\mathbf{8}_{(DR)}$ is pulled in the backward direction B by the lower end of the lever 9$r$, and the slider $\mathbf{8}_{(DR)}$ thereby moves in the backward direction B by a predetermined amount as illustrated in FIGS. 9($b$), 10($b$), 11($b$), and 12A(b).

During such an opening operation in the first stage, as illustrated in FIG. 10($b$), the pressed part 5$c$ of the common beam $\mathbf{5}a_{(CM1)}$ is pressed by an inclined step surface 8$e$ of the common second pressing part $\mathbf{8}c_{(CM1)}$, and the common beam $\mathbf{5}a_{(CM1)}$ is thereby further bent in the downward direction D. Accordingly, the first pressing part 5$b$ of the common beam $\mathbf{5}a_{(CM1)}$ further presses the intermediate part of the common linear part $7a_{(CM1)}$ in the downward direction D, and the common linear part $7a_{(CM1)}$ is thereby further bent in the downward direction D. Thus, the common movable contact $Y_{(CM1)}$ slides against the common stationary contact $X_{(CM1)}$, which increases a contact force between the common movable contact $Y_{(CM1)}$ and the common stationary contact $X_{(CM1)}$. Further, the closed circuit state between the common movable contact $Y_{(CM1)}$ and the common stationary contact $X_{(CM1)}$ is maintained.

During the opening operation in the first stage, as illustrated in FIG. 11(*b*), the pressed part 5*c* of the opening beam $5a_{(DRO)}$ is pressed by an inclined step surface 8*f* of the opening second pressing part $8c_{(DRO)}$ while sliding on the step surface 8*f*, and the opening beam $5a_{(DRO)}$ is thereby bent in the downward direction D. Accordingly, the first pressing part 5*b* of the opening beam $5a_{(DRO)}$ presses the intermediate part of the opening linear part $7a_{(DRO)}$ in the downward direction D, and the opening linear part $7a_{(DRO)}$ is thereby bent in the downward direction D. Thus, the opening movable contact $Y_{(DRO)}$ makes contact with the opening stationary contact $X_{(DRO)}$ while sliding thereon. That is, the opening movable contact $Y_{(DRO)}$ and the opening stationary contact $X_{(DRO)}$ are brought into a closed circuit state.

On the other hand, during the opening operation in the first stage, as illustrated in FIG. 12A(b), the pressed part 5*c* of the automation beam $5a_{(DRA)}$ is kept inserted in the recess 8*a* of the slider $8_{(DR)}$ and separated from an inclined step surface 8*f* of the automation second pressing part $8c_{(DRA)}$. That is, the pressed part 5*c* of the automation beam $5a_{(DRA)}$ is not pressed by the automation second pressing part $8c_{(DRA)}$. Thus, the automation beam $5a_{(DRA)}$ is not bent in the downward direction D, and the automation linear part $7a_{(DRA)}$ is also not bent in the downward direction D. Thus, the automation movable contact $Y_{(DRA)}$ is kept separated from the automation stationary contact $X_{(DRA)}$. That is, the automation movable contact $Y_{(DRA)}$ and the automation stationary contact $X_{(DRA)}$ maintain an open circuit state.

Although not illustrated, during the opening operation in the first stage, the pressed part 5*c* of the closing beam $5a_{(DRC)}$ is kept inserted in the recess 8*a* of the slider $8_{(DR)}$ and thus not pressed by the closing second pressing part $8c_{(DRC)}$. Thus, the closing movable contact $Y_{(DRC)}$ is kept separated from the closing stationary contact $X_{(DRC)}$. Accordingly, the closing movable contact $Y_{(DRC)}$ and the closing stationary contact $X_{(DRC)}$ maintain an open circuit state.

In FIG. 8, as described above, when the common contacts $Y_{(CM1)}$, $X_{(CM1)}$ and the opening contacts $Y_{(DRO)}$, $X_{(DRO)}$ are in a closed circuit state, and the other contacts $Y_{(DRC)}$, $X_{(DRC)}$, $Y_{(DRA)}$, $X_{(DRA)}$ are in an open circuit state, the CPU 11 determines that a manual opening operation for the window at the driver seat has been performed. Then, the CPU 11 drives the corresponding electric motor to open the window glass of the window at the driver seat while the common contacts $Y_{(CM1)}$, $X_{(CM1)}$ and the opening contacts $Y_{(DRO)}$, $X_{(DRO)}$ are maintained in a closed circuit state.

<Automatic Opening Operation>

As illustrated in FIG. 9(*c*), when the front head 9f of the operation knob $9_{(DR)}$ is further pushed down to operate the operation knob $9_{(DR)}$ in the opening direction in a second stage, the lever 9*r* further turns in the opening direction so as to further tilt forward by a predetermined angle. Accordingly, the back part of the slider $8_{(DR)}$ is further pulled in the backward direction B by the lower end of the lever 9*r*, and the slider $8_{(DR)}$ thereby further moves in the backward direction B by a predetermined amount as illustrated in FIGS. 9(*c*), 10(*c*), 11(*c*), and 12B(b') and 12B(c).

During such an opening operation in the second stage, as illustrated in FIG. 10(*c*), the pressed part 5*c* of the common beam $5a_{(CM1)}$ is pressed by a step upper surface 8*g* of the common second pressing part $8c_{(CM1)}$ (the lower face of the slider $8_{(DR)}$) while sliding on the step upper surface 8*g*, and the common beam $5a_{(CM1)}$ is thereby bent in the downward direction D. Further, the first pressing part 5*b* of the common beam $5a_{(CM1)}$ presses the intermediate part of the common linear part $7a_{(CM1)}$, and the common linear part $7a_{(CM1)}$ is thereby bent in the downward direction D. Thus, the common movable contact $Y_{(CM1)}$ is kept in contact with the common stationary contact $X_{(CM1)}$, and a closed circuit state between the common movable contact $Y_{(CM1)}$ and the common stationary contact $X_{(CM1)}$ is maintained.

During the opening operation in the second stage, as illustrated in FIG. 11(*c*), the pressed part 5*c* of the opening beam $5a_{(DRO)}$ is pressed by a step upper surface 8*g* of the opening second pressing part $8c_{(DRO)}$ while sliding on the step upper surface 8*g*, and the opening beam $5a_{(DRO)}$ is thereby bent in the downward direction D. Further, the first pressing part 5*b* of the opening beam $5a_{(DRO)}$ presses the intermediate part of the opening linear part $7a_{(DRO)}$, and the opening linear part $7a_{(DRO)}$ is thereby bent in the downward direction D. Thus, the opening movable contact $Y_{(DRO)}$ is kept in contact with the opening stationary contact $X_{(DRO)}$, and the closed circuit state between the opening movable contact $Y_{(DRO)}$ and the opening stationary contact $X_{(DRO)}$ is maintained.

Further, during the opening operation in the second stage, as illustrated in FIG. 12B(b'), the pressed part 5*c* of the automation beam $5a_{(DRA)}$ is pressed by the inclined step surface 8*f* of the automation second pressing part $8c_{(DRA)}$ at the F direction side while sliding on the inclined step surface 8*f*, and the automation beam $5a_{(DRA)}$ is thereby bent in the downward direction D. Further, the first pressing part 5*b* of the automation beam $5a_{(DRA)}$ presses the intermediate part of the automation linear part $7a_{(DRA)}$, and the automation linear part $7a_{(DRA)}$ is thereby bent in the downward direction D. Thus, the automation movable contact $Y_{(DRA)}$ makes contact with the automation stationary contact $X_{(DRA)}$ while sliding thereon. That is, the automation movable contact $Y_{(DRA)}$ and the automation stationary contact $X_{(DRA)}$ are brought in to a closed circuit state.

Then, as illustrated in FIG. 12B(c), the pressed part 5*c* of the automation beam $5a_{(DRA)}$ climbs on a step upper surface 8*g* of the automation second pressing part $8c_{(DRA)}$ at the F direction side and is pressed by the step upper surface 8*g*. Accordingly, the automation beam $5a_{(DRA)}$ is further bent in the downward direction D, and the automation linear part $7a_{(DRA)}$ pressed by the first pressing part 5*b* of the automation beam $5a_{(DRA)}$ is further bent in the downward direction D. Thus, the automation movable contact $Y_{(DRA)}$ is kept in contact with the automation stationary contact $X_{(DRA)}$ while sliding thereon, and the closed circuit state between the automation movable contact $Y_{(DRA)}$ and the automation stationary contact $X_{(DRA)}$ is maintained.

Although not illustrated, during the opening operation in the second stage, the pressed part 5*c* of the closing beam $5a_{(DRC)}$ is kept inserted in the recess 8*a* of the slider $8_{(DR)}$ and thus not pressed by the closing second pressing part $8c_{(DRC)}$. Thus, an open circuit state between the closing movable contact $Y_{(DRC)}$ and the closing stationary contact $X_{(DRC)}$ is maintained.

In FIG. 8, as described above, when the common contacts $Y_{(CM1)}$, $X_{(CM1)}$, the opening contacts $Y_{(DRO)}$, $X_{(DRO)}$, and the automation contacts $Y_{(DRA)}$, $X_{(DRA)}$ are in a closed circuit state, and the other contacts $Y_{(DRC)}$, $X_{(DRC)}$ are in an open circuit state, the CPU 11 determines that an automatic opening operation for the window at the driver seat has been performed. Then, the CPU 11 drives the corresponding electric motor to open the window glass of the window at the driver seat to a full open position.

<Manual Closing Operation>

As illustrated in FIG. 13(*d*), when the front head 9f of the operation knob $\mathbf{9}_{(DR)}$ is pulled up to operate the operation knob $\mathbf{9}_{(DR)}$ in a closing direction (the clockwise direction in FIG. 13(*d*)) in a first stage, the lever 9*r* turns in the closing direction so as to tilt backward by a predetermined angle. Accordingly, the back part of the slider $\mathbf{8}_{(DR)}$ is pushed in the forward direction F by the lower end of the lever 9*r*, and the slider $\mathbf{8}_{(DR)}$ thereby moves in the forward direction F by a predetermined amount as illustrated in FIGS. 13(*d*), 14(*d*), 15(*d*), and 16(*d*).

Figure 14D:
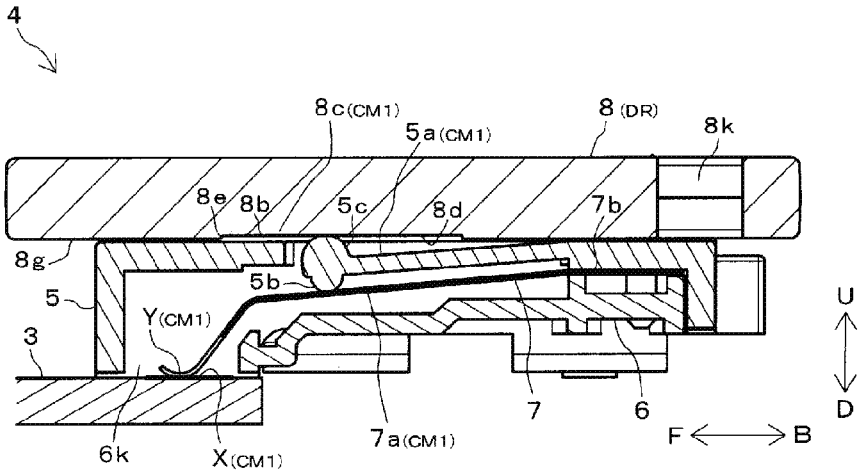
FIGS. 14(*d*) and 14(*e*) are sectional views taken along line A'-A' of FIG. 3 in a closing operation.
Figure 14E:
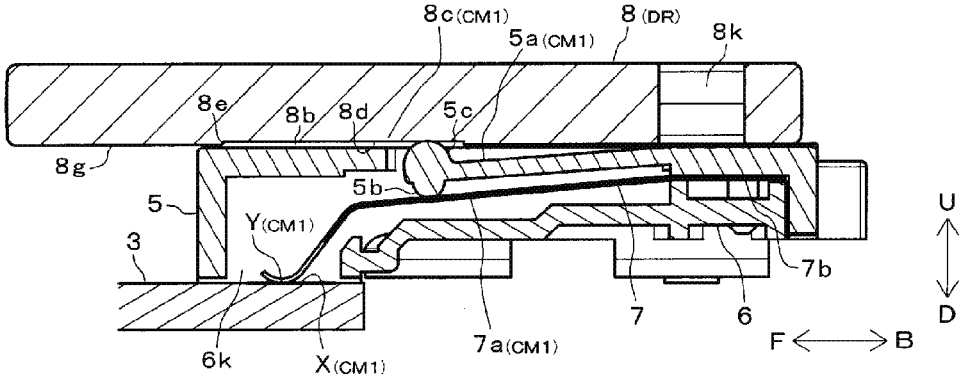
Figure 15A:
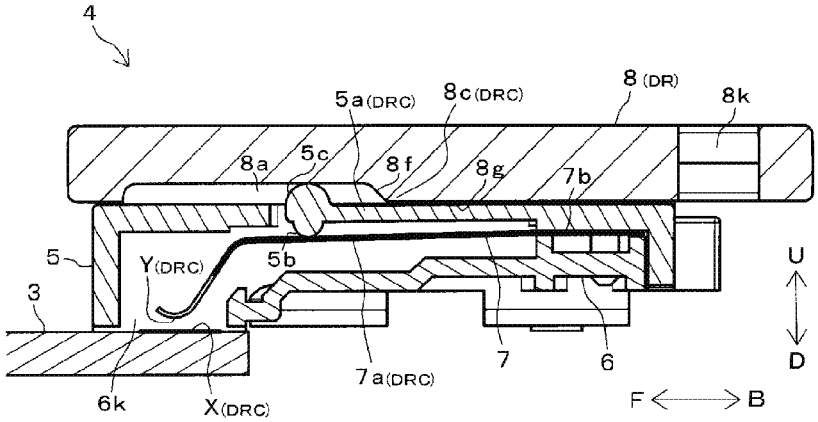
FIGS. 15(*a*), 15(*d*), and 15(*e*) are sectional views taken along line C-C of FIG. 3 in a neutral state and a closing operation.
Figure 15D:
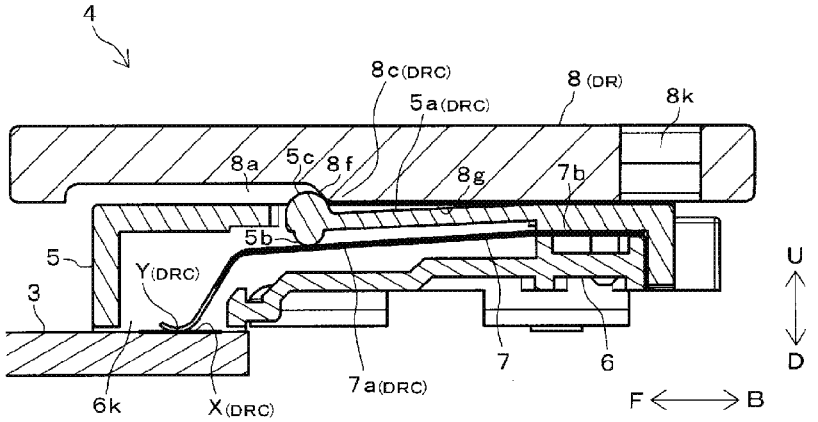
Figure 15E:
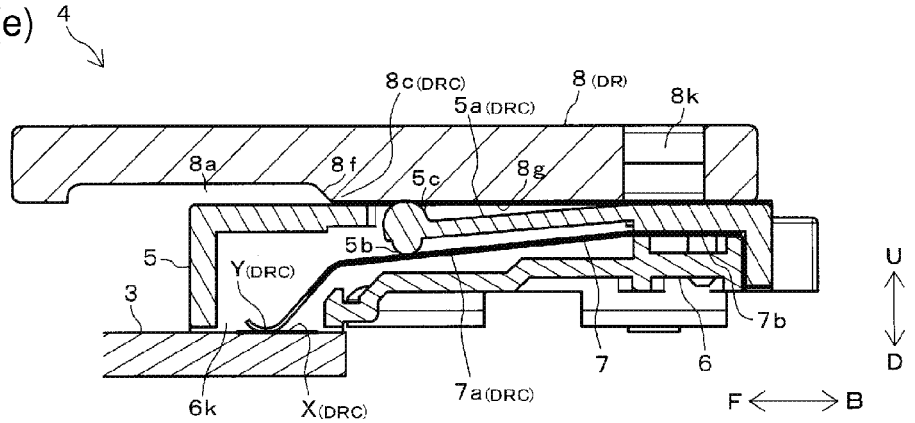

During such a closing operation in the first stage, as illustrated in FIG. 14(*d*), the pressed part 5*c* of the common beam $\mathbf{5}a_{(CM1)}$ is fitted into the recess 8*b* of the slider $\mathbf{8}_{(DR)}$ and continuously pressed by a step lower surface 8*d* of the common second pressing part $\mathbf{8}c_{(CM1)}$. Thus, a state of the common beam $\mathbf{5}a_{(CM1)}$ bent in the downward direction D and a state of the common linear part $\mathbf{7}a_{(CM1)}$ bent in the downward direction D are maintained, and the common movable contact $Y_{(CM1)}$ and the common stationary contact $X_{(CM1)}$ are kept in contact with each other. That is, a closed circuit state between the common movable contact $Y_{(CM1)}$ and the common stationary contact $X_{(CM1)}$ is maintained.

During the closing operation in the first stage, as illustrated in FIG. 15(*d*), the pressed part 5*c* of the closing beam $\mathbf{5}a_{(DRC)}$ is pressed by an inclined step surface 8*f* of the closing second pressing part $\mathbf{8}c_{(DRC)}$ while sliding on the step surface 8*f*, and the closing beam $\mathbf{5}a_{(DRC)}$ is thereby bent in the downward direction D. Accordingly, the first pressing part 5*b* of the closing beam $\mathbf{5}a_{(DRC)}$ presses the intermediate part of the closing linear part $\mathbf{7}a_{(DRC)}$ in the downward direction D, and the closing linear part $\mathbf{7}a_{(DRC)}$ is thereby bent in the downward direction D. Thus, the closing movable contact $Y_{(DRC)}$ makes contact with the closing stationary contact $X_{(DRC)}$ while sliding thereon. That is, the closing movable contact $Y_{(DRC)}$ and the closing stationary contact $X_{(DRC)}$ are brought into a closed circuit state.

Figure 16D:
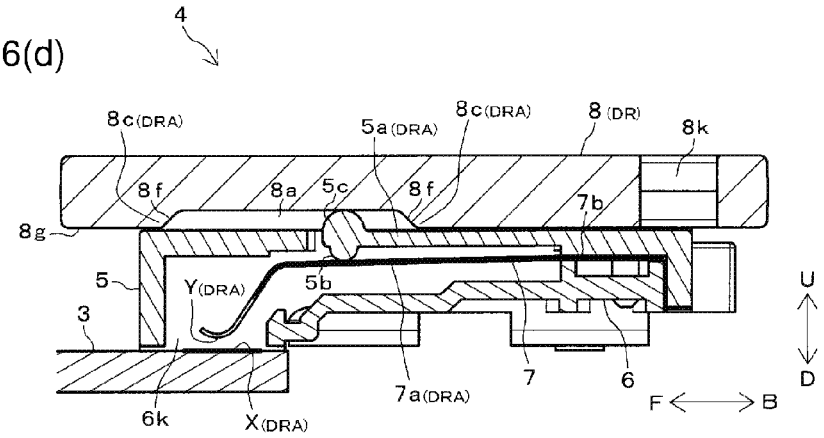
FIGS. 16(*d*), 16(*d'*), and 16(e) are sectional views taken along line D-D of FIG. 3 in a closing operation.
Figure 16D:
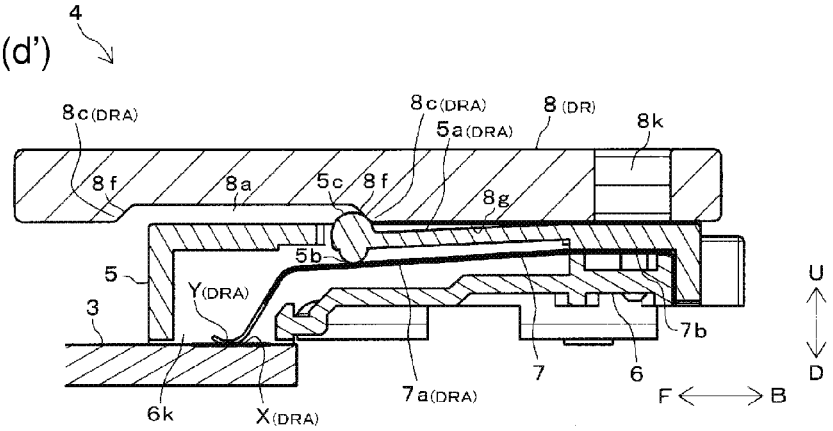
Figure 16E:
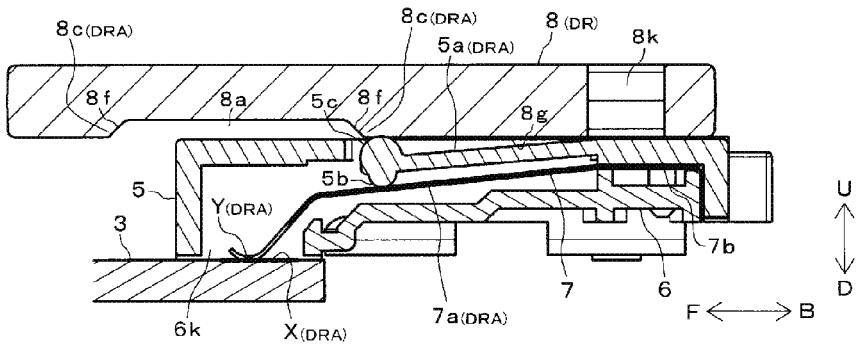

Further, during the closing operation in the first stage, as illustrated in FIG. 16(*d*), the pressed part 5*c* of the automation beam $\mathbf{5}a_{(DRA)}$ is kept inserted in the recess 8*a* of the slider $\mathbf{8}_{(DR)}$ and separated from a step surface 8*f* of the automation second pressing part $\mathbf{8}c_{(DRA)}$. That is, the pressed part 5*c* of the automation beam $\mathbf{5}a_{(DRA)}$ is not pressed by the automation second pressing part $\mathbf{8}c_{(DRA)}$. Thus, the automation beam $\mathbf{5}a_{(DRA)}$ and the automation linear part $\mathbf{7}a_{(DRA)}$ are not bent in the downward direction D. Thus, the automation movable contact $Y_{(DRA)}$ is kept separated from the automation stationary contact $X_{(DRA)}$. That is, the automation movable contact $Y_{(DRA)}$ and the automation stationary contact $X_{(DRA)}$ maintain an open circuit state.

Although not illustrated, during the closing operation in the first stage, the pressed part 5*c* of the opening beam $\mathbf{5}a_{(DRO)}$ is kept inserted in the recess 8*a* of the slider $\mathbf{8}_{(DR)}$ and thus not pressed by the opening second pressing part $\mathbf{8}c_{(DRO)}$. Thus, the opening movable contact $Y_{(DRO)}$ is kept separated from the opening stationary contact $X_{(DRO)}$, and the opening movable contact $Y_{(DRO)}$ and the opening stationary contact $X_{(DRO)}$ maintain an open circuit state.

In FIG. 8, as described above, when the common contacts $Y_{(CM1)}$, $X_{(CM1)}$ and the closing contacts $Y_{(DRC)}$, $X_{(DRC)}$ are in a closed circuit state and the other contacts $Y_{(DRO)}$, $X_{(DRO)}$, $Y_{(DRA)}$, $X_{(DRA)}$ are in an open circuit state, the CPU 11 determines that a manual closing operation for the window at the driver seat has been performed. Then, the CPU 11 drives the corresponding electric motor to close the window glass of the window at the driver seat while the common contacts $Y_{(CM1)}$, $X_{(CM1)}$ and the closing contacts $Y_{(DRC)}$, $X_{(DRC)}$ are maintained in a closed circuit state.

<Automatic Closing Operation>

As illustrated in FIG. 13(*e*), when the front head 9f of the operation knob $\mathbf{9}_{(DR)}$ is further pulled up to operate the operation knob $\mathbf{9}_{(DR)}$ in the closing direction in a second stage, the lever 9*r* further turns in the closing direction so as to further tilt backward by a predetermined angle. Accordingly, the back part of the slider $\mathbf{8}_{(DR)}$ is further pushed in the forward direction F by the lower end of the lever 9*r*, and the slider $\mathbf{8}_{(DR)}$ further moves in the forward direction F by a predetermined amount as illustrated in FIGS. 13(*e*), 14(*e*), 15(*e*), 16(*d'*), and 16(e).

During such a closing operation in the second stage, as illustrated in FIG. 14(*e*), the pressed part 5*c* of the common beam $\mathbf{5}a_{(CM1)}$ is fitted into the recess 8*b* of the slider $\mathbf{8}_{(DR)}$ and continuously pressed by the step lower surface 8*d* of the common second pressing part $\mathbf{8}c_{(CM1)}$. Thus, a state of the common beam $\mathbf{5}a_{(CM1)}$ bent in the downward direction D and a state of the common linear part $\mathbf{7}a_{(CM1)}$ bent in the downward direction D are maintained, and the common movable contact $Y_{(CM1)}$ and the common stationary contact $X_{(CM1)}$ are kept in contact with each other. That is, a closed circuit state between the common movable contact $Y_{(CM1)}$ and the common stationary contact $X_{(CM1)}$ is maintained.

During the closing operation in the second stage, as illustrated in FIG. 15(*e*), the pressed part 5*c* of the closing beam $\mathbf{5}a_{(DRC)}$ is pressed by a step upper surface 8*g* of the closing second pressing part $\mathbf{8}c_{(DRC)}$ while sliding on the step upper surface 8*g*, and the closing beam $\mathbf{5}a_{(DRC)}$ is thereby bent in the downward direction D. Further, the first pressing part 5*b* of the closing beam $\mathbf{5}a_{(DRC)}$ presses the intermediate part of the closing linear part $\mathbf{7}a_{(DRC)}$, and the closing linear part $\mathbf{7}a_{(DRC)}$ is thereby bent in the downward direction D. Thus, the closing movable contact $Y_{(DRC)}$ is kept in contact with the closing stationary contact $X_{(DRC)}$, and a closed circuit state between the closing movable contact $Y_{(DRC)}$ and the closing stationary contact $X_{(DRC)}$ is maintained.

Further, during the closing operation in the second stage, as illustrated in FIG. 16(*d'*), the pressed part 5*c* of the automation beam $\mathbf{5}a_{(DRA)}$ is pressed by the step surface 8*f* of the automation second pressing part $\mathbf{8}c_{(DRA)}$ at the B direction side while sliding on the step surface 8*f*, and the automation beam $\mathbf{5}a_{(DRA)}$ is thereby bent in the downward direction D. Accordingly, the first pressing part 5*b* of the automation beam $\mathbf{5}a_{(DRA)}$ presses the intermediate part of the automation linear part $\mathbf{7}a_{(DRA)}$, and the automation linear part $\mathbf{7}a_{(DRA)}$ is thereby bent in the downward direction D. Thus, the automation movable contact $Y_{(DRA)}$ makes contact with the automation stationary contact $X_{(DRA)}$ while sliding thereon. That is, the automation movable contact $Y_{(DRA)}$ and the automation stationary contact $X_{(DRA)}$ are brought in to a closed circuit state.

Then, as illustrated in FIG. 16(*e*), the pressed part 5*c* of the automation beam $\mathbf{5}a_{(DRA)}$ climbs on the step upper surface 8*g* of the automation second pressing part $\mathbf{8}c_{(DRA)}$ at the B direction side and is pressed by the step upper surface 8*g*. Accordingly, the automation beam $\mathbf{5}a_{(DRA)}$ is further bent in the downward direction D, and the automation linear part $\mathbf{7}a_{(DRA)}$ pressed by the first pressing part 5*b* of the automation beam $5a_{(DRA)}$ is further bent in the downward direction D. Thus, the automation movable contact $Y_{(DRA)}$ is kept in contact with the automation stationary contact $X_{(DRA)}$ while sliding thereon, and the closed circuit state between the automation movable contact $Y_{(DRA)}$ and the automation stationary contact $X_{(DRA)}$ is maintained.

Although not illustrated, during the closing operation in the second stage, the pressed part 5*c* of the opening beam $5a_{(DRO)}$ is kept inserted in the recess 8*a* of the slider $8_{(DR)}$ and thus not pressed by the opening second pressing part $8c_{(DRO)}$. Thus, an open circuit state between the opening movable contact $Y_{(DRO)}$ and the opening stationary contact $X_{(DRO)}$ is maintained.

In FIG. 8, as described above, when the common contacts $Y_{(CM1)}$, $X_{(CM1)}$, the closing contacts $Y_{(DRC)}$, $X_{(DRC)}$, and the automation contacts $Y_{(DRA)}$, $X_{(DRA)}$ are in a closed circuit state, and the other contacts $Y_{(DRO)}$, $X_{(DRO)}$ are in an open circuit state, the CPU 11 determines that an automatic closing operation for the window at the driver seat has been performed. Then, the CPU 11 drives the corresponding electric motor to close the window glass of the window at the driver seat to a full closed position.

In an illustrative embodiment, the stationary contacts X are arranged side by side in the left-right direction L, R on the substrate 3. The housings 5, 6 hold the contact 7 so that each of the movable contacts Y faces the corresponding one of the stationary contacts X on the upper side U of the stationary contacts X. That is, the stationary contacts X and the movable contacts Y are arranged side by side in the left-right directions L, R in a collective manner on the substrate 3. Thus, the substrate 3 of the switch device 100 can be downsized compared to a substrate in which a plurality of contacts are arranged in a dispersed manner in the front-back direction F, B and the left-right direction L, R.

When the slider 8 is moved in the front-back direction F, B, each of the second pressing parts 8*c* of the slider 8 presses the corresponding pressed part 5*c* of the upper housing 5, and the corresponding beam 5*a* of the upper housing 5 is thereby bent in the downward direction D. Then, each of the first pressing parts 5*b* of the upper housing 5 presses the corresponding linear part 7*a* of the contact 7, and the linear part 7*a* is thereby bent in the downward direction D. Accordingly, each of the movable contacts Y of the contact 7 comes into contact with the corresponding one of the stationary contacts X. During the contact, each of the movable contacts Y slides against the corresponding one of the stationary contacts X. Thus, the surfaces of both the movable contact Y and the stationary contact X are cleaned, which enables contact reliability between the movable contact Y and the stationary contact X to be improved.

Except for the common contacts X, Y, the movable contact Y is separated from the substrate 3 and the stationary contact X in a normal neutral state and brought into contact with the substrate 3 and the stationary contact X when the slider 8 moves. Thus, wear on the movable contact Y, the stationary contact X, and the substrate 3 can be reduced.

In an illustrative embodiment, the stationary contacts X and the movable contacts Y are disposed at positions that are off the position directly under the operation knobs 9. The sliders 8 are disposed in a manner to extend from the position directly under the operation knobs 9 to the position directly above the upper housing 5. The lever 9*r* turns by operating the operation knob 9, which reciprocates the slider 8 in the front-back direction F, B. Thus, the stationary contacts X can be arranged in a row and the movable contacts Y can be arranged in a row at any positions that are off the position directly under the operation knobs 9, which enables downsizing of the substrate 3 and enables the structure directly under the operation knobs 9 to be simplified. Further, the back part of the upper case 1 located directly under the operation knobs 9 can be downsized in the height direction U, D. Further, it is possible to increase the flexibility in the arrangement of the stationary contacts X and the movable contacts Y.

In an illustrative embodiment, a pressing length of pressing the pressed part 5*c* of the upper housing 5 in the downward direction D by the second pressing part 8*c* changes according to a moving length of the slider 8 in the front-back direction F, B. Thus, a bent amount of the beam 5*a* of the upper housing 5 and a bent amount of the linear part 7*a* of the contact 7 change according to the moving length of the slider 8 in the front-back direction F, B. Accordingly, it is possible to change a contact pressure of the movable contact Y against the substrate 3 and the stationary contact X. Further, the beam 5*a* of the upper housing 5 and the linear part 7*a* of the contact 7 are bent in the downward direction D in response to the movement of the slider 8 in the front-back direction F, B. Accordingly, it is possible to push the movable contact Y of the contact 7 against the stationary contact X so as to slide thereon.

In an illustrative embodiment, the second pressing part 8*c* of the slider 8 includes the projecting step projecting in an inclined manner toward the upper housing 5 in the front-back direction F, B. The pressed part 5*c* of the upper housing 5 includes the projecting curved surface projecting toward the slider 8. Thus, it is possible to stably bend the beam 5*a* of the upper housing 5 in the downward direction D while allowing the second pressing part 8*c* and the pressed part 5*c* to smoothly slide. The first pressing part 5*b* of the upper housing 5 includes the projecting curved surface projecting toward the contact 7. Thus, it is possible to stably bend the linear part 7*a* in the downward direction D while allowing the first pressing part 5*b* and the linear part 7*a* of the contact 7 to smoothly slide, so that the movable contact Y slides on the stationary contact X.

In an illustrative embodiment, the positions of the opening second pressing part, the closing second pressing part, the automation second pressing part, and the common second pressing part of the slider 8 are shifted from each other in the front-back direction F, B. Thus, operating the operation knob 9 in the opening/closing direction in the first stage moves the slider 8 in the front-back direction F, B by a predetermined amount, which allows the opening or closing second pressing part to bend the opening or closing beam. Further, the opening or closing beam bends the opening or closing linear part, which allows the opening or closing movable contact to come into contact with the opening or closing stationary contact. Further, operating the operation knob 9 in the opening/closing direction in the second stage further moves the slider 8 in the front-back direction F, B by a predetermined amount, which allows the automation second pressing part to bend the automation beam. Further, the automation beam bends the automation linear part, which allows the automation movable contact to come into contact with the automation stationary contact. That is, the operation of the operation knob 9 performed in stages enables a plurality of pairs of movable contacts Y and stationary contacts X to be sequentially brought into contact with each other.

In an illustrative embodiment, the common second pressing part constantly presses the pressed part of the common beam, and the first pressing part of the common beam constantly presses the common linear part so that the common movable contacts $Y_{(CM1)}$, $Y_{(CM2)}$ and the common stationary contacts $X_{(CM1)}$, $X_{(CM2)}$ are normally closed contacts. When the operation knob 9 is in a neutral state, the other second pressing parts do not press the pressed parts of the beams, and the first pressing parts of the beams do not press the linear parts. Thus, the other movable contacts Y and the other stationary contacts X are normally open contacts. Further, the common stationary contacts $X_{(CM1)}$, $X_{(CM2)}$ are connected to ground, the other stationary contacts X are connected to the power source $V_{CC}$, and the movable contacts Y are electrically connected to each other. Thus, it is not necessary to provide the common stationary contacts $X_{(CM1)}$, $X_{(CM2)}$ and the common movable contacts $Y_{(CM1)}$, $Y_{(CM2)}$ for each operation knob 9. Accordingly, it is possible to reduce the number of common stationary contacts $X_{(CM1)}$, $X_{(CM2)}$ and the number of common movable contacts $Y_{(CM1)}$, $Y_{(CM2)}$) to further downsize the substrate 3. In this example, the two common stationary contacts $X_{(CM1)}$, $X_{(CM2)}$ and the two common movable contacts $Y_{(CM1)}$, $Y_{(CM2)}$ are provided with respect to the four operation knobs 9.

In an illustrative embodiment, the common movable contact $Y_{(CM1)}$ as a normally closed contact slides against the common stationary contact $X_{(CM1)}$ in conjunction with the operation of the operation knob $\mathbf{9}_{(DR)}$ for the window at the driver seat which is the most frequently operated one of the plurality of operation knobs 9. Although not described in detail, the common movable contact $Y_{(CM2)}$ as a normally closed contact slides against the common stationary contact $X_{(CM2)}$ in conjunction with the operation of the operation knob $\mathbf{9}_{(AS)}$ for the window at the passenger seat which is the second most frequently operated one. Thus, the common movable contacts $Y_{(CM1)}$, $Y_{(cM2)}$ as normally closed contacts respectively frequently slide against the common stationary contacts $X_{(CM1)}$, $X_{(CM2)}$. Accordingly, the surfaces of both the common movable contacts $Y_{(CM1)}$, $Y_{(CM2)}$ and the common stationary contacts $X_{(CM1)}$, $X_{(CM2)}$ are cleaned, which enables the contact reliability therebetween to be improved. Since two pairs of common movable contacts and stationary contacts are provided, even when there is a contact failure in one of the two pairs of common movable contacts and stationary contacts, the CPU 11 can detect an open circuit state or a closed circuit state of the other pair of movable contact and stationary contact which are in contact with each other.

The disclosure can employ various embodiments other than an illustrative embodiment. For example, although, in an illustrative embodiment, there has been described an example in which the beam 5*a* of the upper housing 5 and the linear part 7*a* of the contact 7 have a cantilever structure, the disclosure is not limited only thereto. Alternatively, for example, the housing and the contact may be formed of an easily bendable material, and the beam and the linear part may have a both-end supported beam structure. Each movable contact may be disposed on the lower face of the intermediate part of the linear part other than the lower face of the tip of the linear part.

Although, in an illustrative embodiment, there has been described an example in which the second pressing part, the beam, the linear part, the movable contact, and the stationary contact are provided so as to correspond to each other in a one-to-one relationship, the disclosure is not limited only thereto. Alternatively, any one of the second pressing part, the beam, the linear part, the movable contact, and the stationary contact may be provided so as to correspond in one-to-plural relationship to the others.

Although, in an illustrative embodiment, the switch device 100 provided with the four operation knobs 9 has been described as an example, the disclosure is not limited only thereto. Alternatively, for example, the disclosure can be applied to a switch device provided with one or two operation knobs. Further, the disclosure can be applied not only to the switch device 100 having both a manual opening/closing function and an automatic opening/closing function, but also to a switch device having only a manual opening/closing function.

Figure 17:
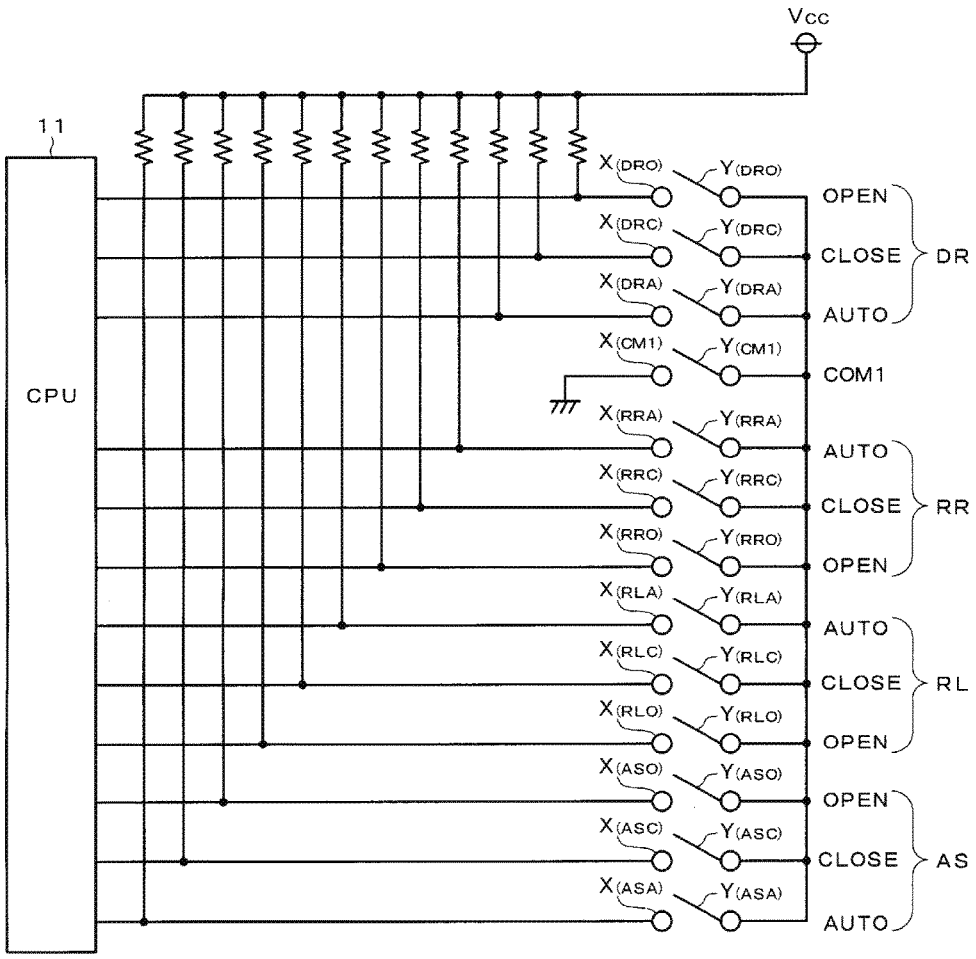
FIG. 17 is an electric circuit diagram of a switch device according to one or more embodiments of the disclosure.

Although, in an illustrative embodiment, there has been described an example in which the two common movable contacts $Y_{(CM1)}$, $Y_{(CM2)}$ and the two common stationary contacts $X_{(CM1)}$, $X_{(CM2)}$ are provided, the disclosure is not limited only thereto. Alternatively, for example, the second common movable contact $Y_{(CM2)}$ and the second common stationary contact $X_{(CM2)}$ may be omitted, and only the first common movable contact $Y_{(CM1)}$ and the first common stationary contact $X_{(CM1)}$ may be provided as illustrated in FIG. 17. In this case, in the two common second pressing parts $\mathbf{8}c_{(CM1)}$, $\mathbf{8}c_{(CM2)}$, the two common beams $\mathbf{5}a_{(CM1)}$, $\mathbf{5}a_{(CM2)}$, and the two common linear parts $\mathbf{7}a_{(CM1)}$, $\mathbf{7}a_{(CM2)}$ provided as illustrated in FIGS. 4 to 7, the common second pressing part $\mathbf{8}c_{(CM2)}$, the common beam $\mathbf{5}a_{(CM2)}$, and the common linear part $\mathbf{7}a_{(CM2)}$ may also be omitted so that the substrate 3 and the contact module 4 can be downsized in the left-right direction L, R.

In an illustrative embodiment, there has been described an example in which the disclosure is applied to the switch device 100 which opens and closes each of the windows at the driver seat, the passenger seat, and the right and left back seats of the automatic four-wheel vehicle. However, the disclosure can be applied also to other switch devices. The number of elements to be used is not limited to an illustrative embodiment, and may be appropriately selected depending on the function of the switch device.

While the invention has been described with reference to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A switch device comprising:

a substrate comprising a plurality of stationary contacts arranged side by side in a first direction;

a contact comprising a plurality of linear parts having elasticity and a plurality of movable contacts, each of the movable contacts formed on a lower face of the corresponding one of the linear parts;

a housing configured to hold a base of the contact so that each of the stationary contacts faces the corresponding one of the movable contacts, the housing comprising a plurality of beams having elasticity, each of the beams disposed above the corresponding one of the linear parts;

a slider disposed above the housing, the slider configured to move in a second direction perpendicular to the first direction and an up-down direction;

a plurality of first pressing parts, each of the first pressing parts formed on a lower face of the corresponding one of the beams and configured to press the corresponding one of the linear parts downward;

a plurality of pressed parts, each of the pressed parts formed on an upper face of the corresponding one of the beams; and a plurality of second pressing parts formed on the slider, each of the second pressing parts configured to press the corresponding one of the pressed parts downward, wherein, when the slider moves in the second direction, the second pressing parts press the pressed parts to bend the beams downward, the first pressing parts press the linear parts to bend the linear parts downward, and the movable contacts come into contact with the stationary contacts.

2. The switch device according to claim 1, wherein each of the pressed parts comprises a projecting curved surface projecting toward the slider, wherein each of the second pressing parts comprises a projecting step projecting in an inclined manner toward the housing in the second direction, wherein a position of at least one of the second pressing parts is shifted in the second direction with respect to positions of the other second pressing parts, wherein, when the slider moves in the second direction by a predetermined amount, the at least one second pressing part presses the corresponding one of the pressed parts downward, and wherein, when the slider further moves in the second direction by a predetermined amount, the other second pressing parts further press the corresponding pressed parts downward.

3. The switch device according to claim 1, wherein a pressing length of pressing each of the pressed parts downward by the corresponding one of the second pressing parts changes according to a moving length of the slider in the second direction.

4. The switch device according to claim 3, wherein each of the pressed parts comprises a projecting curved surface projecting toward the slider, wherein each of the second pressing parts comprises a projecting step projecting in an inclined manner toward the housing in the second direction, wherein a position of at least one of the second pressing parts is shifted in the second direction with respect to positions of the other second pressing parts, wherein, when the slider moves in the second direction by a predetermined amount, the at least one second pressing part presses the corresponding one of the pressed parts downward, and wherein, when the slider further moves in the second direction by a predetermined amount, the other second pressing parts further press the corresponding pressed parts downward.

5. The switch device according to claim 1, wherein at least one of the second pressing parts constantly presses the corresponding one of the pressed parts and the corresponding one of the first pressing parts constantly presses the corresponding one of the linear parts so that at least one pair of the movable contacts and the stationary contacts is a normally closed contact and the stationary contact is connected to ground, and wherein the other pairs of the movable contacts and the stationary contacts are normally open contacts and the stationary contacts are connected to a power source.

6. The switch device according to claim 5, further comprising a plurality of operation knobs configured to swing, wherein the movable contact of the normally closed contact slides against the stationary contact in conjunction with an operation of at least a most frequently operated one of the operation knobs.

7. The switch device according to claim 1, further comprising:

an operation knob configured to swing; and a lever comprising an upper end coupled to the operation knob and a lower end coupled to the slider, wherein the stationary contacts and the movable contacts are disposed at positions that are off a position directly under the operation knob, wherein the slider is disposed in a manner to extend from the position directly under the operation knob to a position directly above the housing, and wherein, when the operation knob is operated, the lever turns to reciprocate the slider in the second direction.

8. The switch device according to claim 7, wherein a pressing length of pressing each of the pressed parts downward by the corresponding one of the second pressing parts changes according to a moving length of the slider in the second direction.

9. The switch device according to claim 7, wherein each of the pressed parts comprises a projecting curved surface projecting toward the slider, wherein each of the second pressing parts comprises a projecting step projecting in an inclined manner toward the housing in the second direction, wherein a position of at least one of the second pressing parts is shifted in the second direction with respect to positions of the other second pressing parts, wherein, when the slider moves in the second direction by a predetermined amount, the at least one second pressing part presses the corresponding one of the pressed parts downward, and wherein, when the slider further moves in the second direction by a predetermined amount, the other second pressing parts further press the corresponding pressed parts downward.

10. The switch device according to claim 7, wherein at least one of the second pressing parts constantly presses the corresponding one of the pressed parts and the corresponding one of the first pressing parts constantly presses the corresponding one of the linear parts so that at least one pair of the movable contacts and the stationary contacts is a normally closed contact and the stationary contact is connected to ground, and wherein the other pairs of the movable contacts and the stationary contacts are normally open contacts and the stationary contacts are connected to a power source.

* * * * *